US006223826B1

(12) United States Patent
Chau et al.

(10) Patent No.: US 6,223,826 B1
(45) Date of Patent: May 1, 2001

(54) AUTO-EXTENDING/RETRACTING ELECTRICALLY ISOLATED CONDUCTORS IN A SEGMENTED DRILL STRING

(75) Inventors: Albert W. Chau, Woodinville; John E. Mercer, Kent, both of WA (US)

(73) Assignee: Digital Control, Inc., Renton, WA (US)

( * ) Notice: Subject to any disclaimer, the term of this patent is extended or adjusted under 35 U.S.C. 154(b) by 0 days.

(21) Appl. No.: 09/317,308

(22) Filed: May 24, 1999

(51) Int. Cl.[7] ..... E21B 23/00; H01R 4/00

(52) U.S. Cl. ..... 166/380; 166/65.1; 175/320; 439/578

(58) Field of Search ..... 175/320; 166/65.1, 166/380; 439/557, 578

(56) References Cited

U.S. PATENT DOCUMENTS

| | | | | |
|---|---|---|---|---|
| 4,690,212 | | 9/1987 | Termohlen | 166/65.1 |
| 4,902,246 | * | 2/1990 | Samchisen | 439/578 |
| 5,002,503 | * | 3/1991 | Campbell et al. | 439/578 |
| 5,131,464 | * | 7/1992 | Lenhart et al. | 166/65.1 |
| 5,141,051 | * | 8/1992 | Lenhart | 166/65.1 |
| 5,155,442 | | 10/1992 | Mercer . | |
| 5,337,002 | | 8/1994 | Mercer . | |
| 5,366,018 | * | 11/1994 | Van Steenwyk et al. | 166/65.1 |
| 5,444,382 | | 8/1995 | Mercer . | |
| 5,633,589 | | 5/1997 | Mercer . | |
| 5,667,009 | * | 9/1997 | Moore | 166/65.1 |
| 5,993,253 | * | 11/1999 | Sai | 439/578 |
| 6,050,353 | * | 4/2000 | Logan et al. | 175/320 |

* cited by examiner

*Primary Examiner*—William Neuder
(74) *Attorney, Agent, or Firm*—Michael Pritzkau; Steve Shear

(57) ABSTRACT

Arrangements and associated methods are described for providing an isolated electrically conductive path in a system in which a boring tool is moved through the ground in a region. The system includes a drill rig and a drill string which is connected between a boring tool, or other in-ground device, and the drill. The drill string is made up of a plurality of electrically conductive drill pipe sections, each of which includes a section length and all of which are configured for removable attachment with one another to facilitate the extension and retraction of the drill string by one section length at a time. The arrangement associated with each drill pipe section provides part of at least one electrically conductive path along the section length of each drill pipe section, which electrically conductive path is electrically isolated from its associated drill pipe section and extends from the boring tool to the drill rig such that the electrically conductive path is extended by the section length when the drill string is extended by attachment of an additional drill pipe section to the drill string at the drill rig and the electrically conductive path is shortened by the section length when the drill string is shortened by detaching the additional drill pipe section from the drill string at the drill rig.

70 Claims, 13 Drawing Sheets

AUTO-EXTENDING/RETRACTING ELECTRICALLY ISOLATED CONDUCTORS IN A SEGMENTED DRILL STRING

BACKGROUND OF THE INVENTION

The present invention relates generally to underground directional boring and more particularly, to automatically extending and retracting electrically isolated conductors provided in a segmented drill string. An associated method is also disclosed.

Guided horizontal directional drilling techniques are employed for a number of purposes including, for example, the trenchless installation of underground utilities such as electric and telephone cables and water and gas lines. As a further enhancement, state of the art directional drilling systems include configurations which permit location and tracking of an underground boring tool during a directional drilling operation. As will be seen, the effectiveness of such configurations can be improved by providing an electrical pathway between a drill rig which operates the boring tool and the boring tool itself.

Turning to FIG. 1, a horizontal boring operation is illustrated being performed using a boring/drilling system generally indicated by the reference numeral 10. The drilling operation is performed in a region of ground 12 including an existing underground utility 14. The surface of the ground is indicated by reference number 16.

System 10 includes a drill rig 18 having a carriage 20 received for movement along the length of an opposing pair of rails 22 which are, in turn, mounted on a frame 24. A conventional arrangement (not shown) is provided for moving carriage 20 along rails 22. During drilling, carriage 20 pushes a drill string 26 into the ground and, further, is configured for rotating the drill string while pushing. The drill string is made up of a series of individual drill string or drill pipe sections 28, each of which includes any suitable length such as, for example, ten feet. Therefore, during drilling, drill pipe sections must be added to the drill string as it is extended or removed from the drill string as it is retracted. In this regard, drill rig 18 may be configured for automatically or semi-automatically adding or removing the drill string sections as needed during the drilling operation. Underground bending of the drill string enables steering, but has been exaggerated for illustrative purposes.

Still referring to FIG. 1, a boring tool 30 includes an asymmetric face 32 and is attached to the end of drill string 36. Steering of the boring tool is accomplished by orienting face 32 of the boring tool (using the drill string) such that the boring tool is deflected in the desired direction. Boring tool 30 includes a mono-axial antenna such as a dipole antenna 44 which is driven by a transmitter 46 so that a magnetic locating signal 48 is emanated from antenna 44. In one embodiment, power may be supplied to transmitter 46 from a set of batteries 50 via a power supply 52. In another embodiment (not shown), to be described in further detail below, an insulated electrical conductor is installed within the drill string between the drill rig and the boring tool in order to carry power to transmitter 46. A control console 54 is provided at the drill rig for use in controlling and/or monitoring the drilling operation. The control console includes a display screen 56, an input device such as a keyboard 58 and a plurality of control levers 60 which, for example, hydraulically control movement of carriage 20 along with other relevant functions of drill rig operation.

Drill pipe 28 defines a through passage (not shown) for a number of reasons, including considerations of design, manufacturing methods, strength, and weight, but also because typical horizontal directional drilling also requires the use of some type of drilling fluid (not shown), most commonly a suspension of the mineral bentonite in water (commonly referred to as "drilling mud"). Drilling mud, which is generally alkaline, is emitted under pressure through orifices (not shown) in boring tool 30 after being pumped through the interior passage of drill pipes 28 which make up drill string 26. Drilling mud is typically pumped using a mud pump and associated equipment (none of which are shown) that is located on or near drill rig 18. The pressures at which the drilling mud is pumped can vary widely, with a commonly encountered range of operation being 100 PSI to 4,000 PSI, depending on the design and size of the particular drill rig. For proper operation, pipe connections between drill pipe sections 28 must not only be sufficiently strong to join the sections against various thrust, pull and torque forces to which the drill string is subjected, but they must also form a seal so as to not allow the escape of drilling mud from these connections which could result in an unacceptable drop in drilling mud pressure at the orifices of the boring tool.

Continuing to refer to FIG. 1, drilling system 10 may include a portable locator/controller 70 held by an operator 72 for sensing locating signal 48 in a way which allows the underground position of boring tool 30 to be identified. Such portable detectors are described, for example, in U.S. Pat. Nos. 5,155,442, 5,337,002, 5,444,382 and 5,633,589 as issued to Mercer et al, all of which are incorporated herein by reference. Alternatively, one or more detectors (not shown) designed for positioning at fixed, above ground locations may be used, as described in U.S. patent application Ser. No. 08/835,834, filing date Apr. 16, 1997, which is commonly assigned with the present application and is incorporated herein by reference.

Guided horizontal directional drilling equipment is typically employed in circumstances where the inaccuracies and lack of steering capability of non-guided drilling equipment would be problematic. A typical example is the situation illustrated in FIG. 1 in which the intended drill path requires steering the boring tool around, in this instance beneath, obstacles such as utility 14. Guided drilling is also important where the intended path is curved (not shown) or the target destination is more than a short distance (typically over 50 feet) from the starting point. In the latter situation, simply aiming a non-guided boring tool at the target destination from the starting point will seldom result in maintaining a sufficiently accurate drill path and/or arriving reasonably close to the target destination.

While system 10 of FIG. 1 illustrates a "walk-over" type locating system using a steerable boring tool, it should be appreciated that "non-walkover" guidance/locating systems (not shown) are also useful in conjunction with steerable boring tools. The less commonly used non-walkover systems typically utilize an instrumentation/sensor package (not shown) located in the boring tool that is electrically connected directly to console 54 at the drill rig via the aforementioned insulated electrical conductor (not shown) located inside the through passage of the drill string. While batteries 50 may be used in the boring tool to power the instrumentation/sensor package, the insulated conductor may be used to supply electrical power to the instrumentation/sensor package, thus eliminating batteries 50 for reasons which will be seen. At the same time, data may be transmitted from the instrumentation/sensor package to console 54 on the insulated conductor. Data can also be sent to the instrumentation/sensor package for calibration, signal processing and programming.

In the instance of both walkover and non-walkover systems, the objective is to use information obtained from the locating system as a basis for making corrections and adjustments to the direction of steerable boring tool 30 in order to drill a bore hole that follows an intended drill path. Therefore, in most drilling scenarios, a walkover system is particularly advantageous in since the origin of the locating signal leads directly to the position of the boring tool. Typically, the locating signal, in a walkover system, is also used to transmit to above ground locations encoded information including the roll and pitch orientation of boring tool 30 along with temperature and battery voltage readings. Battery powered transmitters often employ one to four replaceable internal "dry-cell" type batteries as a source for electric power.

Although internal battery powered transmitters perform satisfactorily under many conditions, there are a number of limitations associated with their use, most of which are due to the relatively low electric power available from dry-cell batteries. For example, battery life for a self-powered transmitter is relatively short and, under some circumstances, the exhaustion of batteries can result in the need to withdraw an entire drill string for the purpose of replacing batteries in order to complete a drill run. It should also be appreciated that the low power level available from dry-cell batteries, from a practical standpoint, limits the signal strength of locating signal 48. The available signal strength is of concern in relation to the depth at which the boring tool may be tracked. That is, the above ground signal strength of locating signal 48 decays relatively rapidly as depth increases. The maximum operating depth for reliable receipt of locating signal 48 using a dry-cell powered transmitter 46 is limited to approximately 100 feet, depending on the particular design and characteristics of boring tool transmitter 46 and the above ground detector(s) used. This distance may decrease in the presence of passive and active forms of magnetic field interference, such as metallic objects and stray magnetic signals from other sources.

As a result of these limitations, drill head transmitters for walkover systems have been developed that can be powered by an above ground external power source via the aforementioned electrical conductor. That is, the typical electrical conductor for this external power source is similar to that used with non-walkover systems, namely a single insulated wire that connects to the transmitter with the ground return for the electrical circuit including the metallic housing of boring tool 30, drill pipe 28 making up the drill string, and drill rig 18. Even in the case where a locating signal is transmitted from the boring tool, the electric conductor may be used to send information from boring tool 30 to the drill rig including, for example, the roll and pitch orientation of the boring tool, temperature and voltage, using a variety of data encoding and transmission methods. By using the insulated electrical conductor, reliable operational depth may be increased by increasing the output power of transmitter 46 without concern over depletion of internal battery power. Moreover, information encoded on the electrical conductor can be received at the drill rig essentially irrespective of the operating depth of the boring tool.

The prior art practice (not shown) for using externally-powered electronic and electrical devices located in the boring tool has been to insert a piece of insulated electrical conducting wire of appropriate length inside each piece of drill pipe 28 and manually perform a physical splice of the electrical wire to the wire in the prior section of drill pipe 28 each time an additional drill pipe section is added to the drill string. The process typically entails the use of specialized and relatively expensive crimp-on connectors and various types of beat-shrinkable tubing or adhesive wrappings that are mechanically secure, waterproof, and resistant to the chemical and physical properties of drilling mud. The process of interrupting pipe joining operations to manually splice the electrical conductor is labor-intensive and results in significant reductions in drilling productivity. Care must also be taken by the person performing splicing to avoid twisting or pinching the electrical wire, and any failure to properly splice can result in wire breakage and the need to withdraw the drill string to make repairs. For drill rigs having the capability of adding/removing drill pipe automatically or semi-automatically, this otherwise useful time and labor saving function must be disabled or interrupted to allow a manual splice of the electric wire. After completing the drill run, a reverse process of withdrawing the drill string and removing each section of drill pipe 28 from the ground requires cutting the wire each time a section of drill pipe is removed, resulting in considerable waste due to the discard of these once-used electrical wires and splicing materials.

The present invention provides a heretofore unseen and highly advantageous arrangement and associated method which automatically forms an isolated electrically conductive pathway between a drill rig and boring tool as the drill string extending between the drill rig and the boring tool is either extended or shortened.

SUMMARY OF THE INVENTION

As will be described in more detail hereinafter, there are disclosed herein arrangements and an associated method of providing an isolated electrically conductive path in a system in which a boring tool is moved through the ground in a region. The system includes a drill rig and a drill string which is connected between a boring tool, or other in-ground device, and the drill rig and is configured for extension and/or retraction from the drill rig such that, when the drill string is extended, the boring tool moves in a forward direction through the ground and, when the drill string is retracted, the boring tool moves in a reverse direction approaching the drill rig. The drill string is made up of a plurality of electrically conductive drill pipe sections, each of which includes a section length and all of which are configured for removable attachment with one another to facilitate the extension and retraction of the drill string by one section length at a time. The improvement comprises an arrangement associated with each drill pipe section for providing part of at least one electrically conductive path along the section length of each drill pipe section, which electrically conductive path is electrically isolated from its associated drill pipe section and extends from the boring tool to the drill rig such that the electrically conductive path is extended by the section length when the drill string is extended by attachment of an additional drill pipe section to the drill string at the drill rig and the electrically conductive path is shortened by the section length when the drill string is shortened by detaching the additional drill pipe section from the drill string at the drill rig.

BRIEF DESCRIPTION OF THE DRAWINGS

The present invention may be understood by reference to the following detailed description taken in conjunction with the drawings briefly described below.

DETAILED DESCRIPTION OF THE INVENTION

Figure 1:
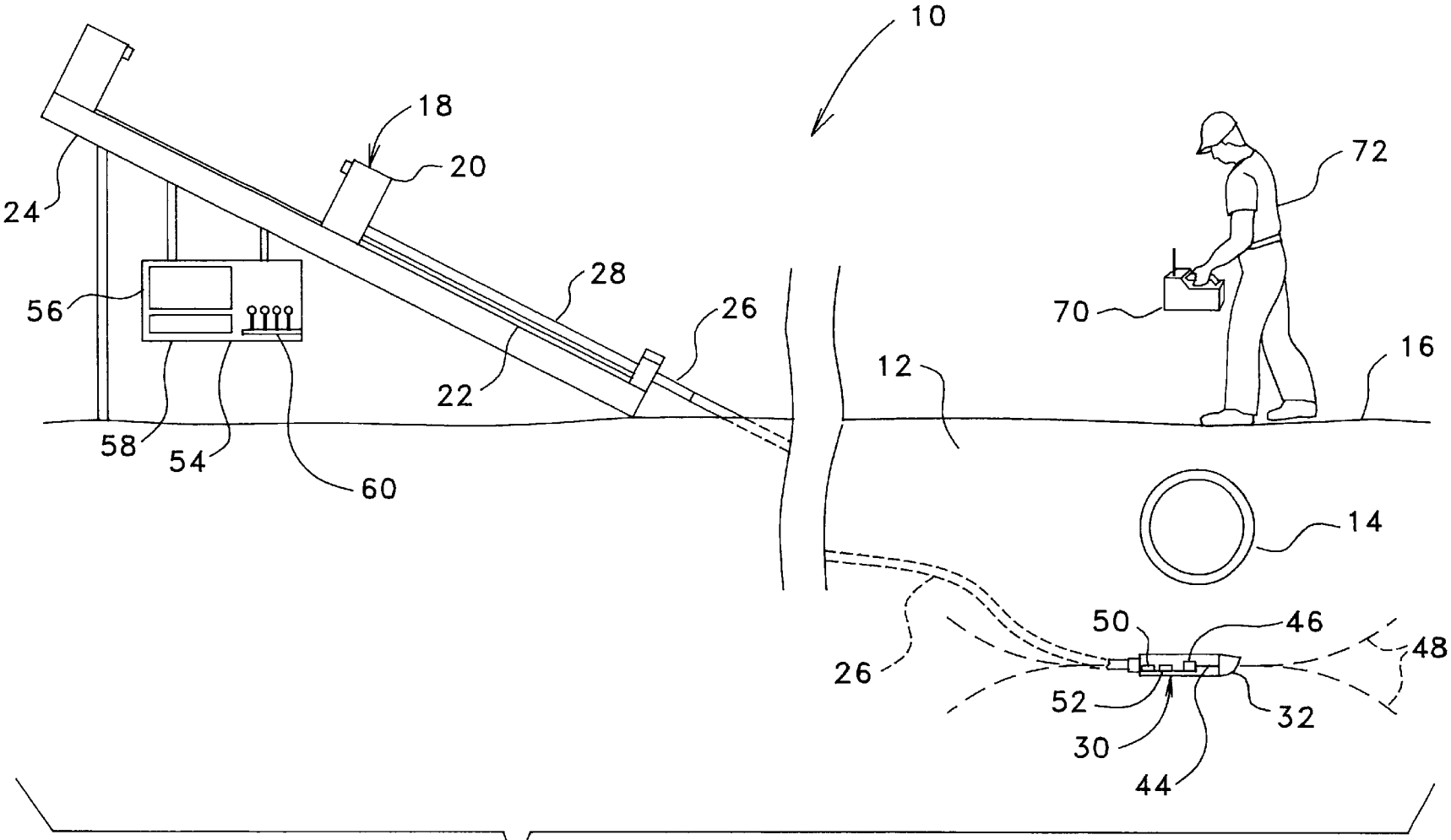
FIG. 1 (PRIOR ART)
FIG. 1 is a diagrammatic elevational view of a drilling operation being performed in a region in accordance with the prior art.
Figure 2:
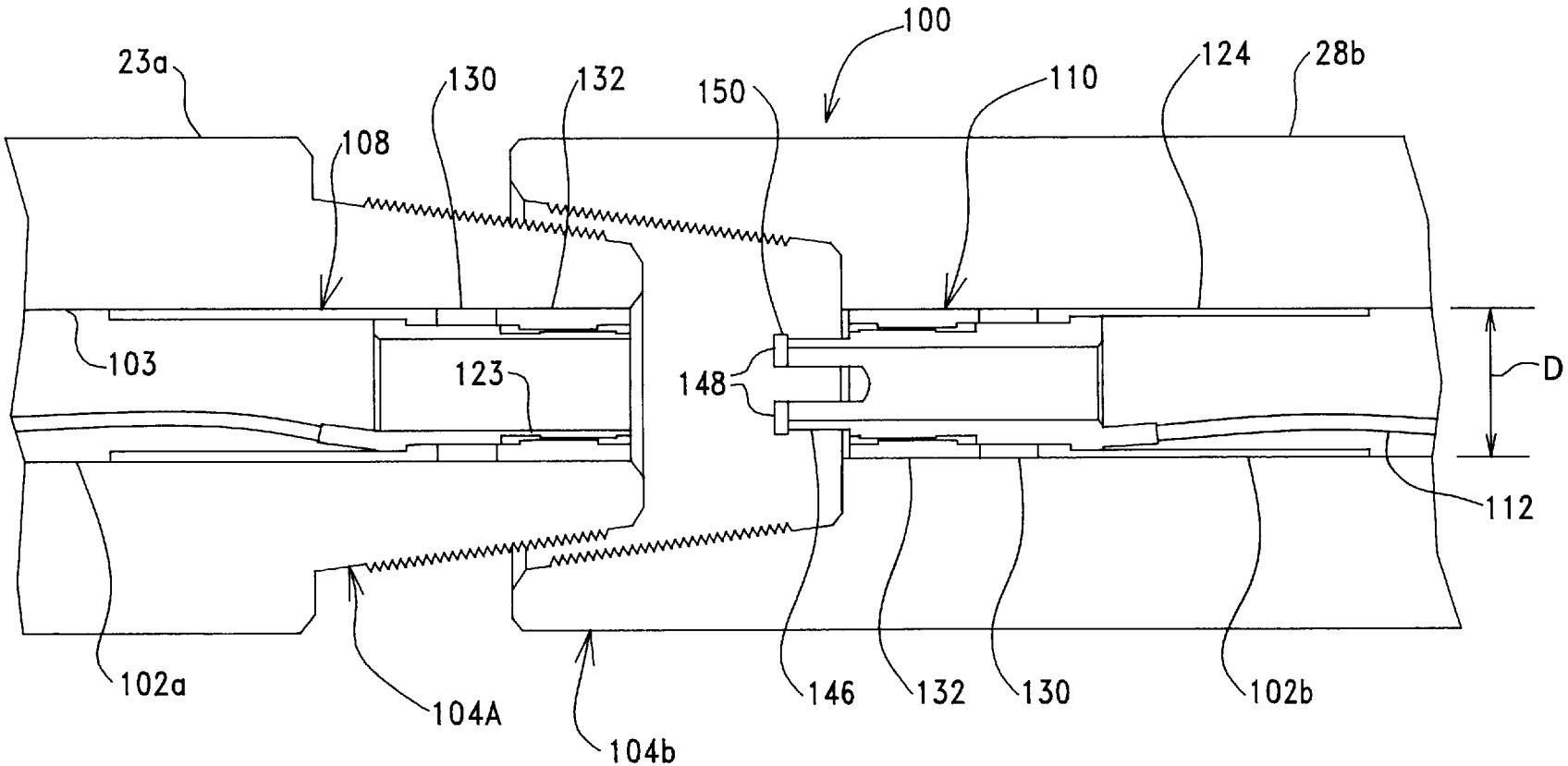
FIG. 2 is a diagrammatic cross-sectional view of adjacent ends of a pair of drill pipe sections shown here to illustrate a first embodiment of an arrangement manufactured in accordance with the present invention for automatically forming a continuous, isolated electrically conductive path between a drill rig and in-ground device.

Having previously described FIG. 1, attention is immediately directed to FIG. 2 which illustrates a first embodiment of an arrangement manufactured in accordance with the present invention and generally indicated by the reference numeral 100 for automatically extending and retracting electrically isolated conductors provided in a segmented drill string. It should be noted that like reference numbers refer to like components throughout the various figures. Moreover, dimensions in the figures have been exaggerated with respect to component sizes and relative spacing for illustrative purposes.

Arrangement 100 is configured for use with standard drill pipe sections such as drill pipe section 28 described above. FIG. 2 illustrates drill pipe sections 28*a* and 28*b* having arrangement 100 installed therein. It should be appreciated that arrangement 100 may be provided as an after market kit for installation in commercially available drill pipe sections which may already be in service or for installation in new drill pipe sections. Alternatively, manufacturers may produce new drill pipe sections having arrangement 100 incorporated therein at the time of manufacture. Drill pipe sections 28 each define through hole 102, indicated by the reference numbers 102*a* and 102*b*, respectively, for drill pipe sections 28*a* and 28*b*. Through holes 102 include a diameter D and define an interior surface 103. Drill pipe section 28*a* includes a threaded pin (male) end fitting 104*a* while drill pipe section 28*b* includes a threaded box (female) end fitting 104*b*. As is typical in the prior art, these end fittings are designed to threadably engage one another, for example, by rotating pin end fitting 104*a* of drill pipe section 28*a* into box end fitting 104*b* of drill pipe section 28*b* during a drilling operation so as to extend the drill string, as described above with regard to FIG. 1. It should be appreciated that the configurations of these end fittings cooperate to produce self alignment as they engage one another, yet produce a suitably strong connection between the drill pipe sections once the end fittings are fully engaged with one another. Moreover, as described with regard to FIG. 1, drilling mud (not shown) is pumped down the drill string and through holes 102*a* and 102*b*. The connection formed between drill pipe sections 28*a* and 28*b* should also prevent the escape of the drilling fluid from the drill string.

Figure 3A:
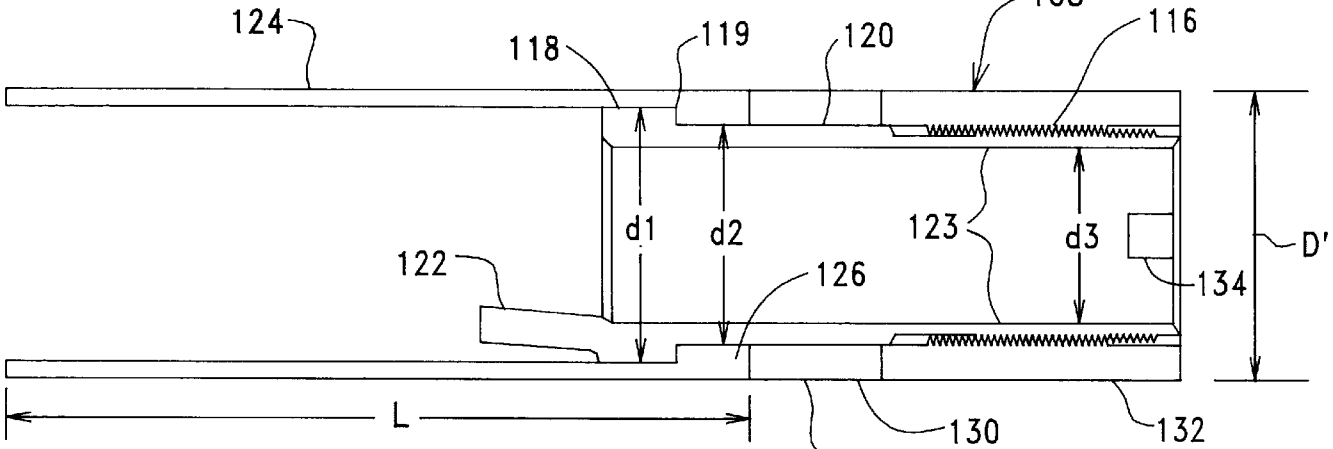
FIG. 3A is a diagrammatic cross-sectional view of a box adapter fitting forming part of the arrangement of FIG. 2 shown here to illustrate details of its construction.
Figure 3B:
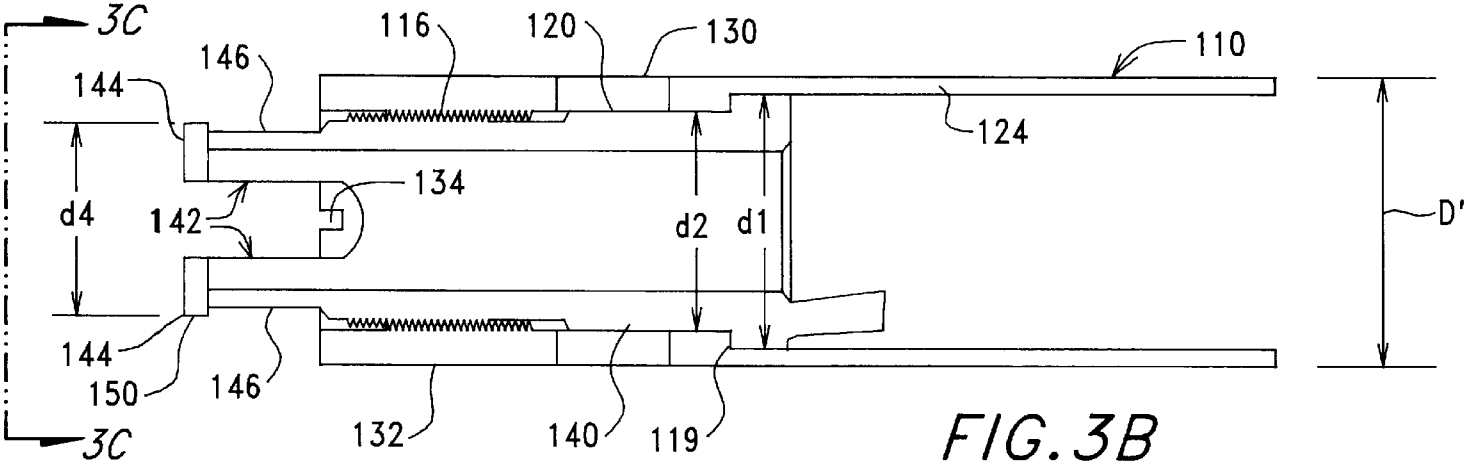
FIG. 3B is a diagrammatic cross-sectional view of a pin adapter fitting forming part of the arrangement of FIG. 2 shown here to illustrate details of its construction and which is configured to mate with the box adapter fitting of FIG. 3A when the fittings are installed in adjacent drill pipe sections.

Referring now to FIGS. 3A and 3B in conjunction with FIG. 2, arrangement 100 includes a box adapter fitting 108 which preferably is positioned in through hole 102*a* of drill pipe section 28*a* and a pin adapter fitting 110 which preferably is positioned in through hole 102*b* of drill pipe section 28*b* for reasons to be described below. FIG. 3A illustrates box adapter fitting 108 while FIG. 3B illustrates pin adapter fitting 110. While only one pair of end fittings of adjacent drill pipe sections have been illustrated, it should be appreciated that each drill pipe section includes opposing ends having a box end fitting at one end and a pin end fitting at its other end. Thus, each drill pipe section in an overall drill string (not shown) receives pin adapter fitting 110 in its box end fitting 104*b* and box adapter fitting 108 in its pin end fitting 104. A length of insulated conductor 112 (only partially shown in FIG. 2) is used to electrically interconnect the pin and adapter fittings associated with each drill pipe section.

Referring primarily to FIG. 3A, box adapter fitting 108 includes a first cylindrically shaped electrically conductive body 114 having a threaded end portion 116, an outwardly projecting peripheral collar 118, having an outer diameter d1, at its opposing end defining a step 119 and an outer peripheral surface 120, having a diameter d2, disposed between peripheral collar 118 and threaded end portion 116. An electrical connection tab 122 extends outwardly from an area of peripheral collar 118 for use in electrical connection with conductor 112 (FIG. 2). The interior surface of conductive body 114 includes a diameter d3 configured to allow the passage of drilling fluid and comprises an electrical contact surface 123. Conductive body 114 may be formed from suitable electrically conductive materials including, but not limited to stainless steel or beryllium copper. A cylindrical electrical insulating sleeve 124 includes a length L and outer diameter D'. Sleeve 124 includes an inwardly projecting peripheral collar 126 defining an entrance diameter approximately equal to d2. The remaining extent of length L of sleeve 124 includes an inner diameter that is slightly greater than d1. Sleeve 124 may be formed from suitable materials such as, for example, delrin. A compression collar 130 is captured between peripheral collar 126 of sleeve 124 and a locking ring 132. The latter is designed to threadably engage threaded end portion 116 of conductive body 114 and is produced from an electrically non-conductive material such as, for example, delrin. Alternatively (not shown), locking ring 132 may include a conductive, threaded inner body surrounded on its exterior by an electrical insulating material. Compression collar 130 may be formed from elastomeric materials such as, for example, polyurethane. Locking ring 132 also includes a pair of opposing notches 134 (as shown by a dashed line) which may be utilized in rotating the locking ring relative to conductive body 114. Specific details regarding the installation and operational use of box adapter fitting 108 will be provided at an appropriate point hereinafter following a description of pin adapter fitting 110.

Turning now to FIG. 3B, pin adapter fitting 110 includes a second cylindrically shaped electrically conductive body 140 having threaded end portion 116, peripheral collar 118, including its outer diameter d1, defining step 119 and outer peripheral surface 120, having a diameter d2, disposed between peripheral collar 118 and threaded end portion 116. Electrical connection tab 122 extends outwardly from an area of peripheral collar 118. Conductive body 140, like previously described conductive body 114, may be formed from suitable electrically conductive materials including, but not limited to beryllium copper and defines a through opening 135 for the passage of drilling fluid. Installation of cylindrical electrical insulating sleeve 124, locking collar 130 and locking ring 132 will be described below.

Figure 3C:
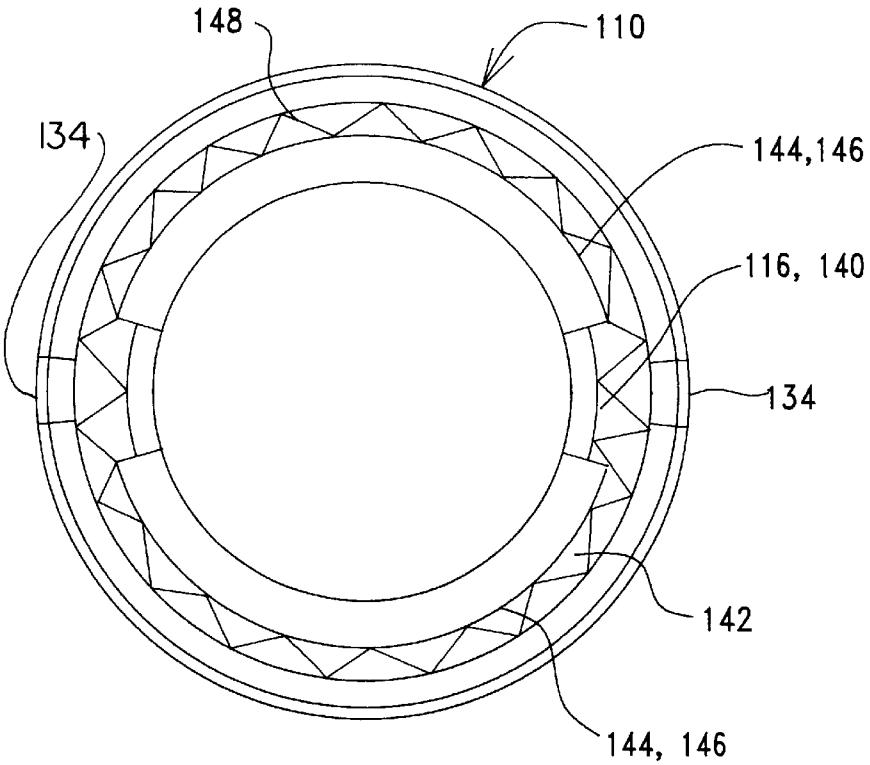
FIG. 3C is an end view of the pin adapter fitting of FIG. 3B shown here to illustrate further details of its construction.

Referring to FIGS. 3B and 3C, second conductive body 140 includes a contact finger arrangement 142 formed as an outermost part of threaded end portion 116. Contact finger arrangement 142 includes an opposing pair of elongated electrical contact fingers 144. Each contact finger includes an elongated contact arm 146 and an end contact 148. Elongated contact arms 146 are preferably integrally formed with conductive body 140. End contacts 148 may be integrally formed with contact arms 146 (not shown) or may be produced separately and attached by any suitable method (as shown) such as, for example, welding. Separately produced end contacts may be formed from suitable electrically conductive materials such as, for example, stainless steel or high strength copper alloy. FIG. 3C shows locking ring 132 threadably engaged with second conductive body 140 using threads 148 of the locking ring and conductive body, where these threads are indicated diagrammatically by a zigzag line. It should be noted that the configuration of contact fingers 144 allows the contact fingers to be biased towards one another such that the contact fingers exert a resilient, outward force against applied inward biasing forces.

Referring to FIGS. 2, 3A and 3B, having generally described the structure of arrangement 100, its installation will now be described. Each adapter fitting is initially assembled by first sliding insulating sleeve 124 onto either conductive body 114 of box adapter fitting 108 or conductive body 140 of pin fitting adapter 110 such that outwardly projecting peripheral collar 118 is received against inwardly projecting peripheral collar 126 of sleeve 124. Compression collar 130 is then positioned on either of the conductive bodies, as shown. Because compression collar 130 is generally formed from elastomeric materials, its inner diameter may be slightly less than d2 so long as the compression collar is positionable as shown. Following installation of the compression collar, locking ring 132 is installed with notches 134 exposed for access thereto.

Following initial assembly of the adapter fittings, installation in a drill pipe section may proceed. Outer diameter D' of box adapter fitting 108 and pin adapter fitting 110 are configured to be less than diameter D of through hole 102 in one of drill pipe sections 102. Therefore, the pin and box adapters are slidably receivable in through hole 102. As illustrated in FIG. 2, box fitting adapter 108 is preferably installed at pin end fitting 104*a* of each drill pipe section while pin fitting adapter 110 is preferably installed at box end fitting 104*b* of each drill pipe section for reasons to be described below.

Installation of the adapters may be performed by first connecting electrical conductor 112 between connection tabs 122 of one box fitting adapter 108 and of one pin fitting adapter 110. Thereafter, for example, pin fitting adapter 110 is inserted, contact finger arrangement 142 first, into through hole 102 at pin end fitting 104*a* of a drill pipe section. Pin fitting adapter 110, with electrical conductor 112 attached, is allowed to slide in the through hole until positioned at box end fitting 104*b* as shown in FIG. 2. At this point, notches 134 of locking ring 132 the pin fitting adapter may be engaged using a specifically configured socket tool (not shown). The locking ring is rotated to compress compression collar 130 between inwardly projecting peripheral collar 126 of insulation sleeve 124 and locking ring 124. As the compression collar is compressed, it expands radially between and against peripheral surface 120 of conductive body 114 or 140 and interior surface 102 (FIG. 2) of a drill pipe section 28. The compression collar is designed to seal against the interior of the drill pipe in order to achieve a tight and secure fit by this radial expansion. In addition, compression collar 130 will allow adapter fittings 108 and 110 to accommodate normal manufacturing variations in the inside diameter of the drill pipe through hole to avoid the need for additional precision machining of the drill pipe. It should be appreciated that use of a threaded engaging configuration permits the removal and/or replacement of the pin and box adapter fittings and/or of other components, such as compression collars 130, by a reverse process and results in a reusable adapter fitting.

Following installation of the pin fitting adapter, as described immediately above, box adapter fitting 108, also connected to conductor 112, is positioned in pin end fitting 104*a* of the drill pipe section and fixed in position in essentially the same manner as pin adapter fitting 110. It should be appreciated that this installation technique may be modified in any suitable manner so long as the illustrated configuration of the adapter fittings and conductor 112 is achieved in the through hole of the drill pipe section. For example, box adapter fitting 108 may be installed first. As another example, conductor 112 may initially be connected to only the adapter fitting to be installed first and, after its installation, with the conductor extending through the drill pipe section, the conductor may be connected to the other adapter fitting prior to its installation.

Turning again to FIG. 2, attention is now directed to the operational use of arrangement 100. FIG. 2 illustrates drill pipe sections 28*a* and 28*b* as these sections are about to be attached with one another. As can be seen in this figure, pin end fitting 104*a* of drill pipe section 28*a* is partially extending within box end fitting 104*b* of drill pipe section 28*b*. In this regard, it should be appreciated that drill pipe sections 28*a* and 28*b* will be brought into substantial alignment by the box and pin end fittings prior to pin adapter fitting 110 engaging box adapter fitting 108. Thus, the possibility of damage to the adapter fittings resulting from misalignment of the drill pipe sections is greatly reduced. With regard to avoiding damage to the adapter fittings, it should be appreciated that installation of pin adapter fitting 110 in box end fitting 104*b* of each drill pipe section affords substantial protection to contact fingers 142 extending outwardly from the through hole of the drill pipe section. That is, installation of pin adapter fitting 110 in pin end fitting 104 of the drill pipe sections (not shown) would cause contact fingers 142 to extrude in a highly exposed manner from the drill pipe section risking damage during virtually any handling of the drill pipe section.

Figure 4:
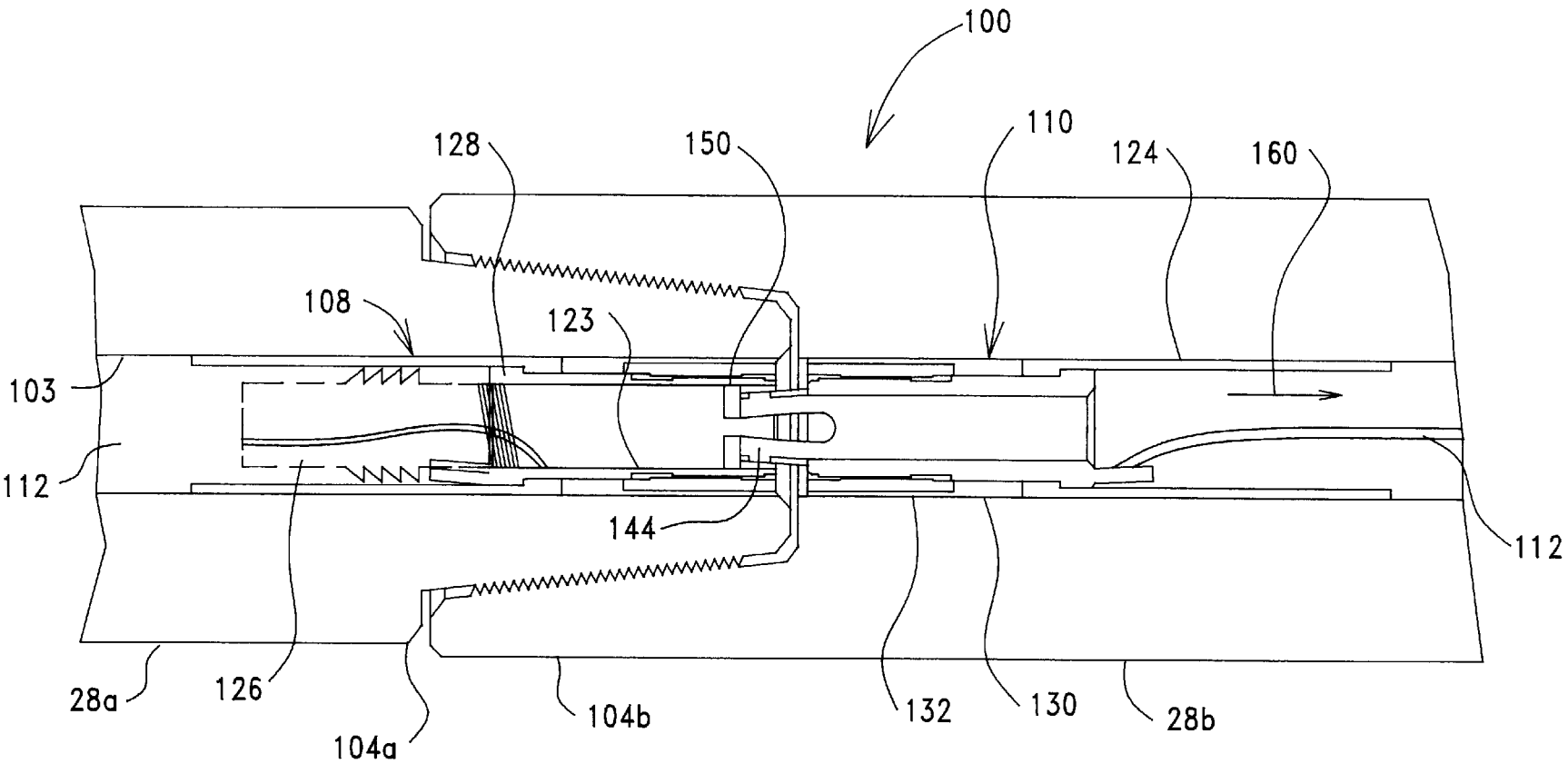
FIG. 4 is a diagrammatic cross-sectional view showing mated, adjacent ends of the pair of drill pipe sections of FIG. 2 illustrating mated pin and box adapter fittings of FIGS. 3A–3C which automatically form a continuous, isolated electrically conductive path in accordance with the present invention.

Referring to FIGS. 2 and 4, as attachment of drill pipe sections 28*a* and 28*b* proceeds from the pre-aligned situation of FIG. 2, pin adapter fitting 110 and box adapter fitting 108 contact one another at a predetermined point (not shown) when substantial alignment has already been achieved between drill pipe sections 28*a* and 28*b*. At this predetermined point, contacts 148 of contact fingers 144 engage electrical contact surface 123 of box adapter fitting 108. As a result, contact finger arms 146 are resiliently biased towards one another in a way which maintains electrical contact between contacts 148 and electrical contact surface 123. Thus, each time an additional drill pipe section is attached to a drill string (not shown) electrical contact is formed between the pin adapter fitting and box adapter fitting, as arranged in the drill pipe section which defines an above ground end of the drill string and the end of the additional drill pipe section to be connected therewith. At the same time, drilling fluid may readily pass through the central through openings defined by the mated box and pin adapter fittings in adjacent drill pipe sections. In accordance with the present invention, arrangement 100 produces an electrically conductive path between a boring tool and a drill rig (such as shown in FIG. 1) in an essentially automatic manner. Arrangement 100 is highly advantageous in this regard since drilling operations need not be interrupted for purposes of maintaining an electrical connection with the boring tool. Therefore, the full advantages attendant to drill rigs configured for automatically adding drill pipe sections to the drill string will be realized while still maintaining a continuous, isolated electrically conductive path between the drill rig and the boring tool. Moreover, this advantage is realized in retraction of the drill string as well as in its advancement. That is, removal of a drill pipe section from the above ground end of the drill string automatically disconnects arrangement 100 within that drill pipe section from the overall continuous, electrically conductive path being maintained between the boring tool and the drill rig. Arrangement 100 is suitable for any application requiring an isolated electrical conductive pathway between the drill rig and the underground end of the drill string. For example, the arrangement may be used with a boring tool to carry electrical power from the drill rig to the boring tool and/or carrying data to and/or from the boring tool. Alternatively, arrangement 100, and other arrangements described below, are useful in utility pullback operations during which it may be useful to send data from the underground end of the drill string to the drill rig. Such information may comprise, for example, tension monitoring data.

Referring to FIGS. 3A, 3B and 4, it should be appreciated that typical drilling fluid (not shown) is pumped down the drill string and flows in the direction indicated by an arrow 160. Because the drilling fluid exhibits electrical conductivity, any direct contact between adapter fittings 108 and the drilling fluid (which is itself in physical and electrical contact with ground via the uninsulated interior walls of the drill pipe sections) will create an electrical pathway to ground and cause loss of power and/or signal. Hereinafter, this electrical pathway may be referred to as the drilling fluid ground path. Therefore, insulative, dielectric coatings (not shown) such as, for example, chromium oxide should be used on surfaces exposed to the drilling fluid other than outer faces 150 (see FIG. 3B) of electrical contacts 148 of pin adapter fitting 110 and electrical contact surface 123 (see FIG. 3A) of box adapter fitting 108. Moreover, extension of insulator sleeve 124 into the through hole of each drill pipe section, substantially beyond (not shown) conductive bodies 114 and 140, serves to reduce the drilling fluid ground path.

Alternatively, pin adapter fitting 110 and tube adapter fitting 108 may be held in place by a separate, replaceable single-use barbed fitting 126 which is shown in phantom in FIG. 4. Barbed fitting 126 may include a threaded end 128 which is designed to engage pin adapter fitting 110 and tube adapter fitting 108 thereby eliminating the need for locking ring 132, the threads on the associated conductive bodies and compression sleeve 130. In this way, the adapter fittings may be removed from one drill pipe section and threaded onto threaded end of the installed barbed fitting in another drill pipe section. Alternatively, a broken barbed fitting may readily be replaced at low cost. The barbed fitting may be formed from suitable materials such as, for example, stainless steel. In using a barbed fitting or any other fitting to be deformably received in a drill pipe through hole, connection tab 122, FIG. 4, should be modified to avoid interference. Alternatively, conductor 112 may be connected directly to surface 123 of box adapter fitting 108 or to the interior surface of the pin adapter fitting (neither connection is shown). If barbed fitting 126 is made from an electrically non-conductive material, insulating sleeve 124 may also be eliminated. Like insulating sleeve 124, a non-conductive barbed fitting may extend well into the drill pipe through hole to reduce the electrical pathway formed through the drilling fluid between the conductive bodies of the adapter fittings and ground.

Figure 5:
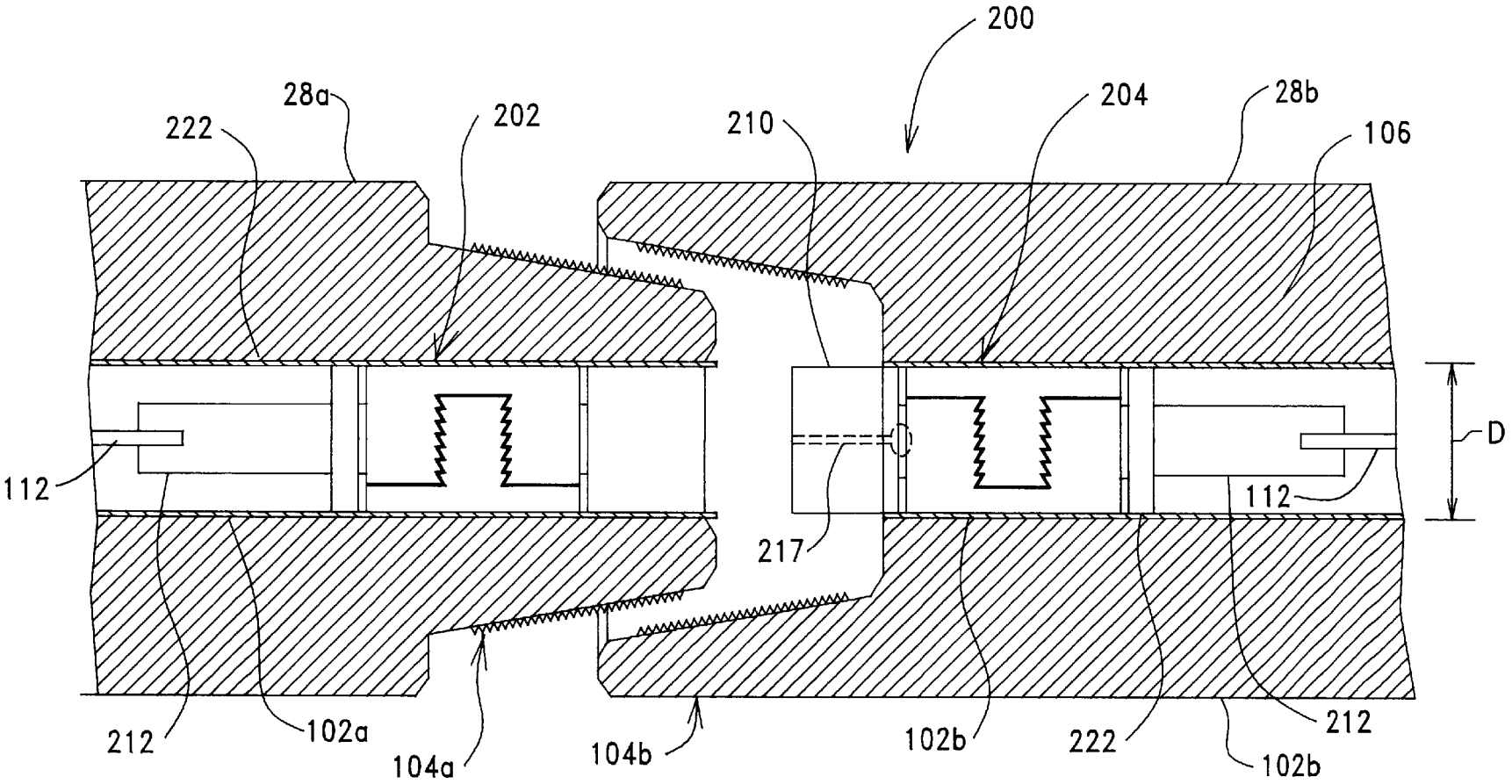
FIG. 5 is a diagrammatic partially cut-away view of adjacent ends of a pair of drill pipe sections shown here to illustrate a second embodiment of an arrangement manufactured in accordance with the present invention for automatically forming a continuous, isolated electrically conductive path between a drill rig and in-ground device.

Attention is now turned to FIG. 5 which illustrates a second embodiment of an arrangement manufactured in accordance with the present invention and generally indicated by reference numeral 200 for automatically extending and retracting electrically isolated conductors provided in a segmented drill string. This figure is a partial cut away plan view having drill pipe sections 28*a* and 28*b* cut away around arrangement 200 for illustrative purposes. Likewise, dimensions in the figures have been exaggerated with respect to component sizes and relative spacing for illustrative purposes.

Like previously described arrangement 100, arrangement 200 is configured for use with standard drill pipe sections such as drill pipe section 28 described above. FIG. 5 illustrates drill pipe sections 28*a* and 28*b* having arrangement 200 installed therein. Further like arrangement 100, it should be appreciated that arrangement 200 may be provided as an after market kit for installation in commercially available drill pipe sections which may already be in service or for installation in new drill pipe sections. Alternatively, manufacturers may produce new drill pipe sections having arrangement 200 incorporated therein at the time of manufacture.

Figure 6C:
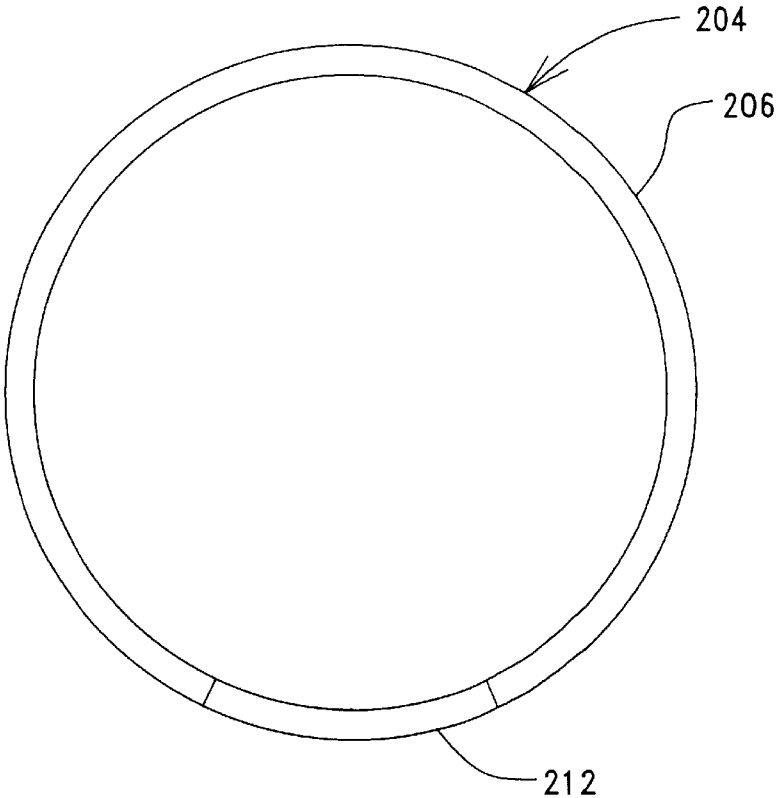
FIG. 6C is an end view of the pin adapter fitting of FIG. 6B shown here to illustrate further details of its construction.
Figure 6A:
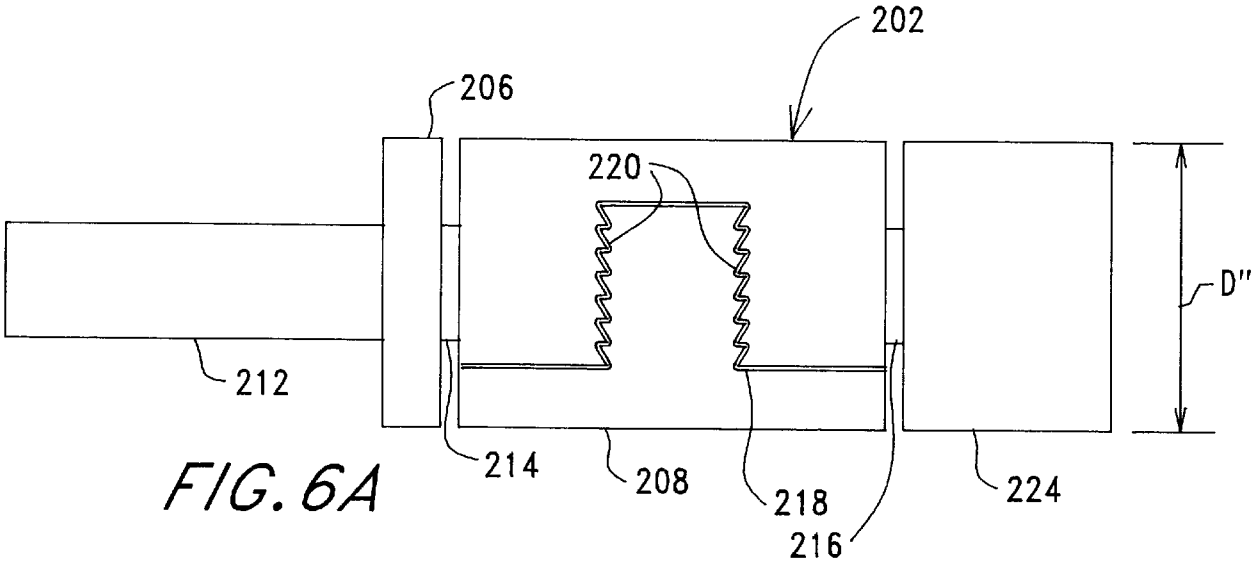
FIG. 6A is a diagrammatic plan view of a box adapter tube fitting forming part of the arrangement of FIG. 5 shown here to illustrate details of its construction.
Figure 6B:
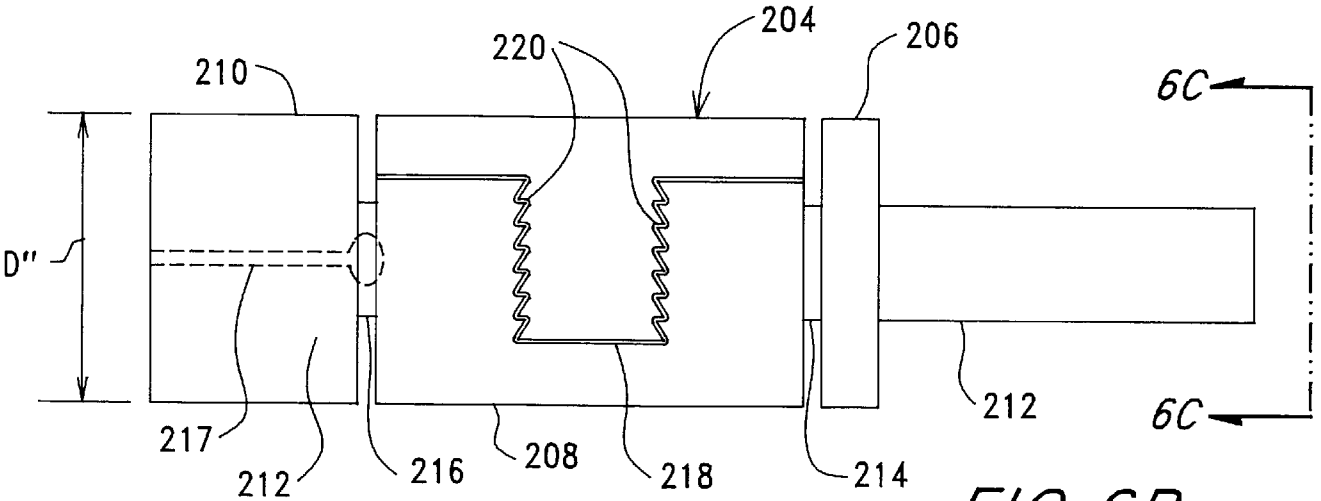
FIG. 6B is a diagrammatic plan view of a pin adapter tube fitting forming part of the arrangement of FIG. 5 shown here to illustrate details of its construction and which is configured to mate with the box adapter tube fitting of FIG. 6A when the adapter tube fittings are installed in adjacent drill pipe sections.

Referring now to FIGS. 6A, 6B and 6C in conjunction with FIG. 5, arrangement 200 includes a box adapter tube fitting 202 which preferably is positioned in through hole 102*a* of drill pipe section 28*a* and a pin adapter tube fitting 204 which preferably is positioned in through hole 102*b* of drill pipe section 28*b* for reasons to be described below. FIG. 6A illustrates box adapter tube fitting 202 in detail while FIG. 6B illustrates pin adapter tube fitting 204 in detail. Even though only one pair of end fittings of adjacent drill pipe sections have been illustrated, it should be appreciated that each drill pipe section includes opposing ends having a box end fitting at one end and a pin end fitting at its other end. Thus, each drill pipe section in an overall drill string (not shown) receives pin adapter tube fitting 204 in its box end fitting 104*b* and box adapter tube fitting 202 in its pin end fitting 104*a*. Insulated conductor 112 (only partially shown in FIG. 5) is used to electrically interconnect the pin and adapter tube fittings associated with each drill pipe section, as will be further described.

First describing pin adapter tube fitting 204 with reference to FIGS. 6B and 6C, the pin adapter tube fitting includes an overall cylindrical shape, which is best seen in the end view of FIG. 6C, having a wall thickness of approximately one-sixteenth of an inch. Other wall thicknesses are equally useful so long as the requirements described below are satisfied. In this regard, it should be appreciated that both the pin and box adapter tubes may be formed from single pieces of tubing, as will be described. Alternately, the various portions of the pin and box adapter tubes to be described can be formed separately (not shown) and interconnected in any suitable manner such as, for example, stainless steel. The pin and box adapter tube fittings may be formed from any suitable material including, but not limited to, stainless steel or high strength copper alloy.

Continuing to describe pin adapter tube fitting 204, a centering ring 206, which is visible in both FIGS. 6B and 6C, a locking body 208 and a pin head arrangement 210 are provided. An arcuate shaped electrical connection tab 212 extends outwardly from centering ring 206 for electrical connection with conductor 112 (FIG. 5). Centering ring 206 and locking body 208 are interconnected by a first arcuate member 214 extending therebetween while pin head arrangement 210 is connected with locking body 208 by a second arcuate member 216. When pin adapter tube fitting 204 is formed from an overall single piece of tubing, arcuate members 214 and 216 are integrally formed with those portions of the pin adapter tube fitting which they serve to interconnect. In cross-section, arcuate members 214 and 216 appear identical to the end view of electrical connection tab 212, as illustrated in FIG. 6C. A compression slot 217 is defined by pin head arrangement 210 and second arcuate member 216 such that circumferential forces around the pin head arrangement will result in a reduced radius. That is, the circumference of the pin head arrangement, particularly at its outermost end can be reduced for reasons to be seen.

Referring to FIG. 6B, locking body 208 includes a specially configured locking cut 218 which extends along the entire length of the locking body and defines two opposing pairs of serrated locking edges 220. The latter are arranged spaced apart from one another and extending partially along the circumference of locking body 208. Owing to suitable flexibility of the material from which the locking body is formed, as well as its thickness, the locking body may be expanded circumferentially in way which causes serrated locking edges 220 of each pair of edges to move in opposite direction directions with respect to one another. During this movement, the serrated edges of each pair are configured so as to engage one another, accomplishing a ratcheting action which maintains circumferential expansion of the locking body.

Referring to FIGS. 5, 6B and 6C, pin adapter tube fitting 204 includes a diameter D" which is designed to be received in an overall insulating tube 222 (see FIG. 5) that is, in turn, received in through hole 102. The pin adapter tube fitting, in combination with insulating tube 222, includes an outer diameter which is less than diameter D of through hole 102 of the drill pipe sections. With serrated edges 220 disengaged, the pin adapter tube fitting received in insulating tube 222 is slidably receivable in through hole 102. Insulating tube 222 may be formed from suitable electrical insulating materials such as, for example, polyurethane which also exhibit at least a certain degree of deformability, for reasons which will become evident. During installation, the pin adapter tube fitting and insulating sleeve are installed within through hole 102*b* of drill pipe section 28*b* such that pin head fitting 210 extends from the through hole into box end fitting 104*b*. Thereafter, locking body 208 is circumferentially expanded against insulating tube 222 to engage locking edges 220 which, in turn, expands against the interior surface of the through hole and is captured between locking body 208 and the interior surface of the through hole. Expansion of locking body 208 to engage serrated edges 220 may be accomplished, for example, by using a swaging tool. For reasons to be described, insulating tube 222 should protrude slightly into box end fitting 104*b*.

Referring to FIGS. 5, 6A and 6B, box adapter tube fitting 202 is essentially identical to pin adapter tube fitting 204 with the exception that pin head arrangement 210 is replaced by a box head arrangement 224. The latter is cylindrical including outer diameter D". Thus, as will be further described, pin head arrangement 210 of the pin adapter tube fitting, through circumferential compression, may be inserted into box head arrangement 224 of box adapter tube fitting 202. The latter is installed in through hole 102*b* of drill pipe section 28*a* such that the outermost end of box head arrangement is generally flush with the end of pin end fitting 104*a*. At the same time, insulating tube 222 around box adapter tube fitting 204 should extend slightly from through hole 102*a* at pin end fitting 104*a*, as will be further described. The box adapter tube fitting and its associated insulating tube 222 are installed in the same manner as described previously with regard to pin adapter tube fitting 204 using locking body 208.

Figure 7:
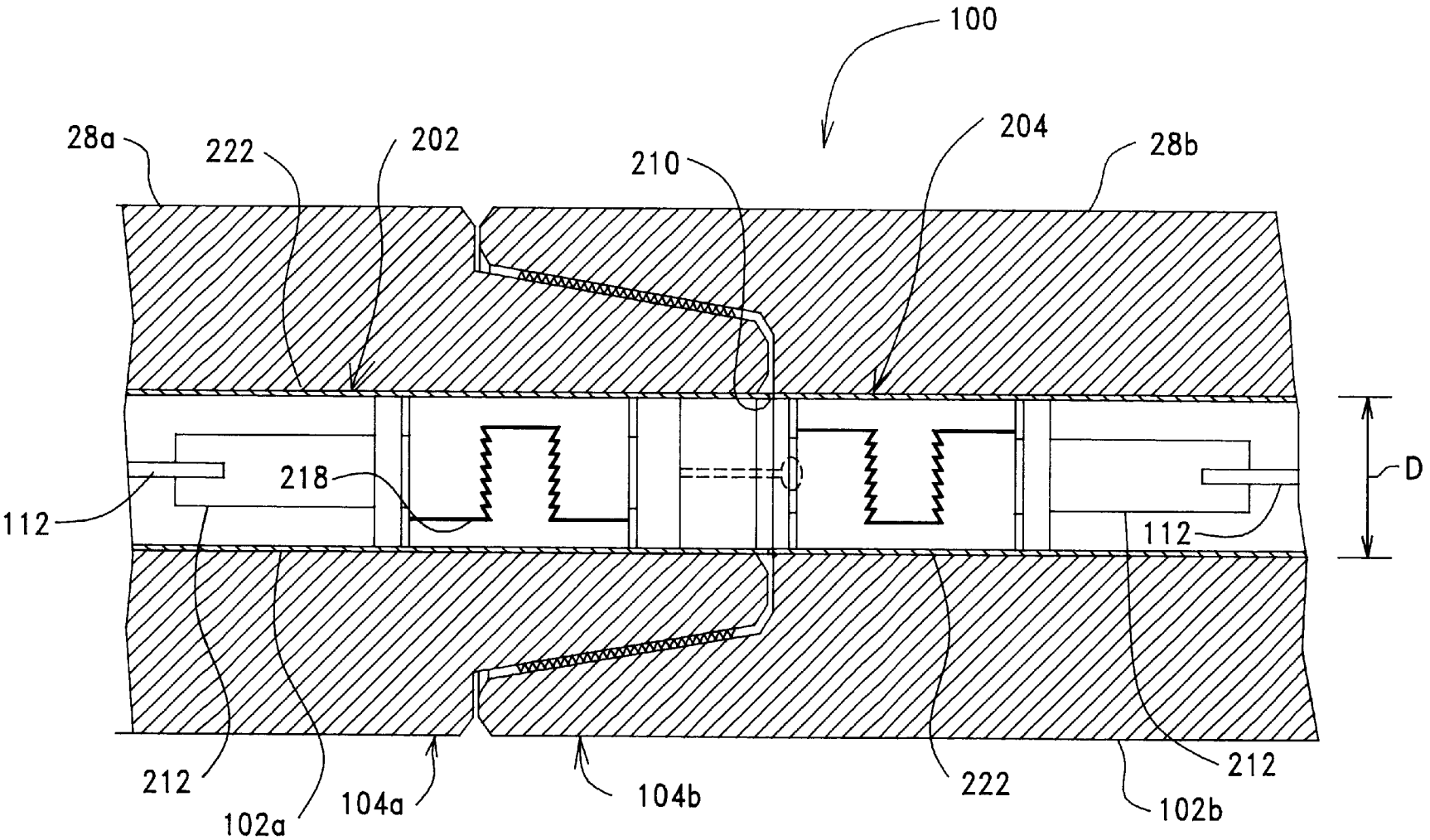
FIG. 7 is a diagrammatic cross-sectional view showing mated, adjacent ends of the pair of drill pipe sections of FIG. 5 illustrating mated pin and box adapter tube fittings according to FIGS. 6A–6C which automatically form a continuous, isolated electrically conductive path in accordance with the present invention.

During operation, with reference primarily taken to FIGS. 5 and 7, pin head fitting 210 of pin adapter tube fitting 204 engages box head arrangement 224 of box adapter tube fitting 202 at a predetermined point once box end fitting 104*b* and pin end fitting 104*a* have engaged one another and are pre-aligned. As engagement of the drill pipe sections proceeds, pin head arrangement 210 is circumferentially compressed by box head arrangement 224 so as to be inserted within the box head arrangement, forming an electrical connection therewith. Thus, an electrical pathway is automatically formed between drill pipe sections as the drill pipe sections are connected with one another. Like previously described arrangement 100, exposed portions of arrangement 200 which contact drilling mud may be coated with dielectric materials in order to isolate the connectors from ground connection via the drilling mud. This isolation is further enhanced by extending insulating tubes 222 further into the interior of the drill pipe section through holes. In this regard, insulating tubes 222 associated with the pin and box adapter tube fitting should extend sufficiently from their associated through holes such that the ends of the insulating sleeves are biased against one another as illustrated in FIG. 7. In this way, electrical conduction to ground is further reduced.

It should be appreciated that arrangement 200 shares all the advantages of previously described arrangement 100 with regard to establishing an isolated electrically conductive path between a boring tool and drill rig. Moreover, because arrangement 200 may be produced at low cost from tubular stock, it is designed for a single use. Locking cut 218 may be cut (not shown), for example, using a laser with an appropriate shield positioned within the tubular stock. In fact, both the box and pin adapter tubes may be cut entirely using a laser.

Figure 8:
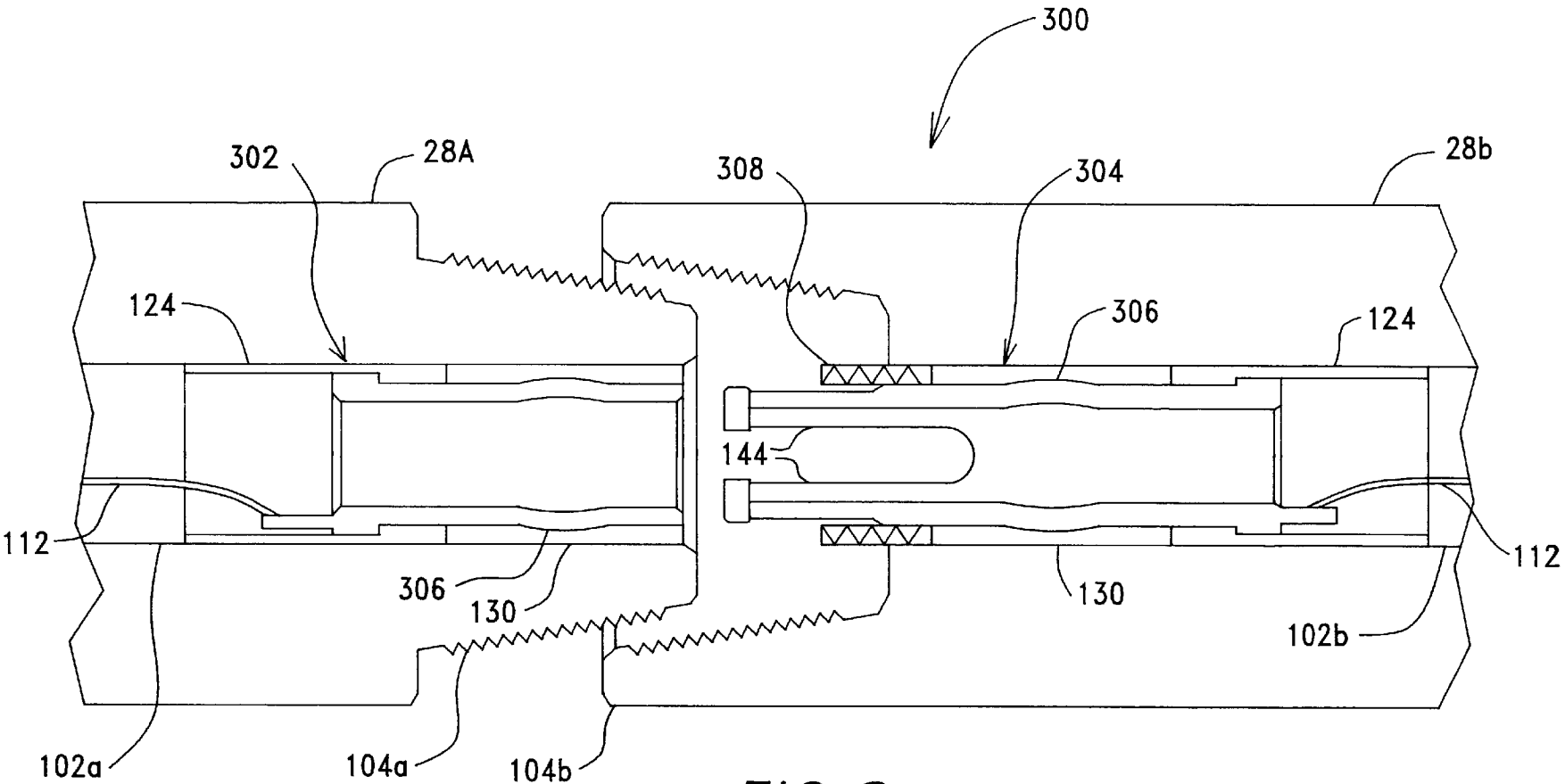
FIG. 8 is a diagrammatic cross sectional view of adjacent ends of the pair of adjacent drill pipe sections shown here to illustrate a third embodiment of an arrangement manufactured in accordance with the present invention for automatically forming a continuous, isolated electrically conductive path between a drill rig and in-ground device.

FIG. 8 illustrates a third embodiment of an arrangement manufactured in accordance with the present invention and generally indicated by reference numeral 300 for automatically extending and retracting electrically isolated conductors provided in a segmented drill string. As in previously described embodiments, arrangement 300 is configured for use with standard drill pipe sections such as drill pipe section 28. FIG. 8 illustrates drill pipe sections 28*a* and 28*b* having arrangement 300 installed therein and with the adjacent drill pipe sections in partial alignment. Furthermore, it should be appreciated that arrangement 300 may be provided as an after market kit for installation in commercially available drill pipe sections which may already be in service or for installation in new drill pipe sections.

Arrangement 300 includes a box adapter fitting 302 which preferably is positioned in through hole 102*a* of drill pipe section 28*a* and a pin adapter fitting 304 which preferably is positioned in through hole 102*b* of drill pipe section 28*b* for reasons described above with regard to protection of the adapter fittings during drilling operations. Each drill pipe section in an overall drill string (not shown) receives pin adapter fitting 304 in its box end fitting 104*b* and box adapter fitting 302 in its pin end fitting 104*a*. Insulated conductor 112 (only partially shown in FIG. 8) is used to electrically interconnect the pin and adapter fittings associated with each drill pipe section, as described above.

Inasmuch as arrangement 300 is similar to arrangement 100 described above, present discussions will be limited primarily to features of arrangement 300 which differ from those of arrangement 100. These features relate for the most part to the manner in which the fittings are mounted in the drill pipe section through holes. Specifically, adapter fittings 302 and 304 each include a deformable conductive body 306 which, in its undeformed condition, is initially inserted into the drill pipe through holes and, thereafter, deformed in a way which squeezes compression sleeve 130 against the interior surface of the drill pipe section through hole to hold the adapter fittings in position. The deformable conductive body may be integrally formed (i.e., including contact fingers 144) from suitable materials such as, for example, stainless steel. Installation of the adapter fittings into drill pipe sections will be described below. Another feature incorporated in arrangement 300 is a bellows seal 308 which is attached to pin adapter fitting 304, for example, by an interference fit. Bellows seal 308 will be described in further detail at an appropriate point below. For the moment, it should be noted that the bellows seal feature may be utilized in any embodiment of the present invention.

Figure 9:
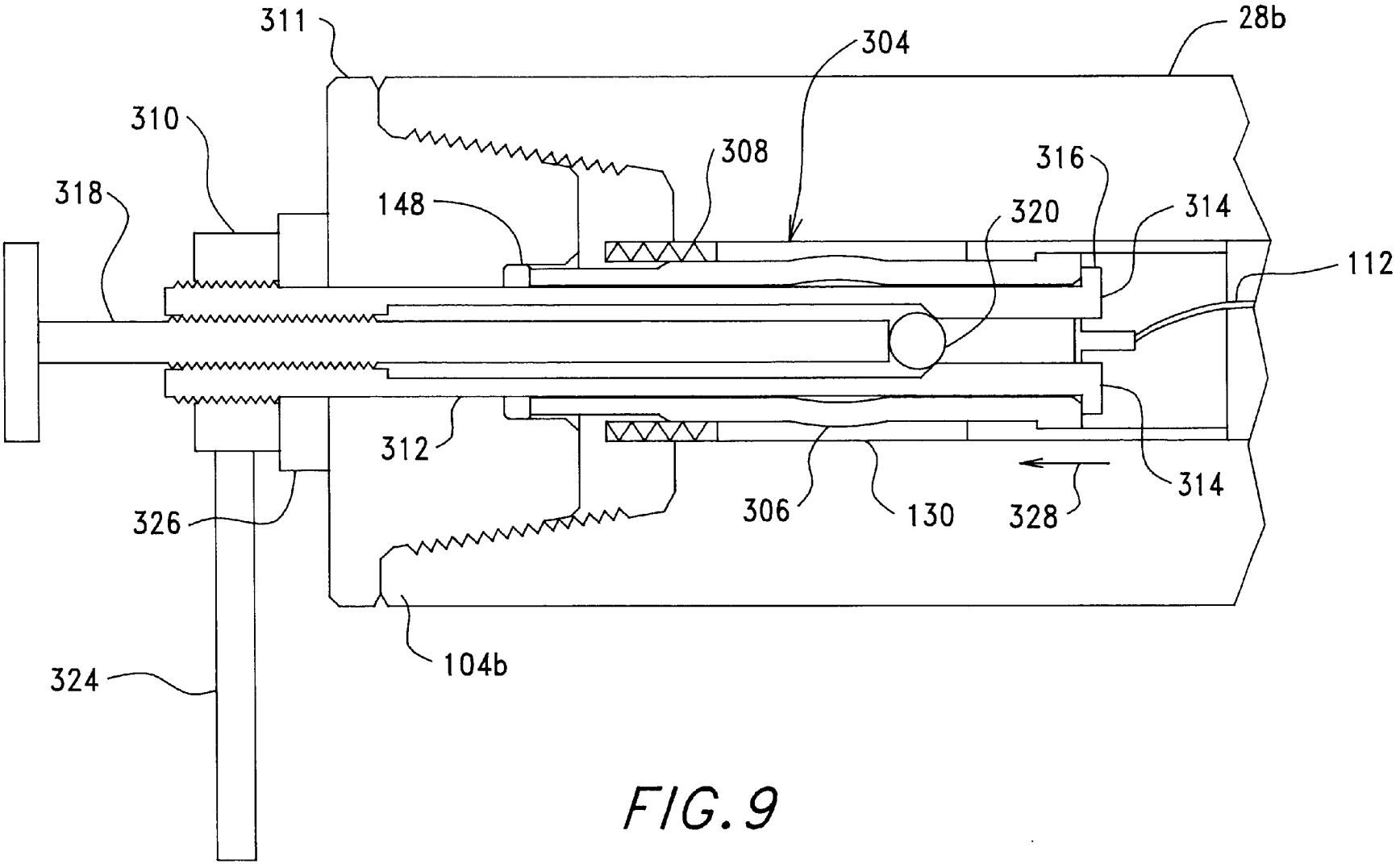
FIG. 9 is a diagrammatic cross sectional view of a tool used in installing adapter fittings which form part of the embodiment illustrated in FIG. 8.

Attention is now directed to FIG. 9 for purposes of describing the installation of adapter fittings 302 and 304 within drill pipe sections 28. Specifically, this figure illustrates installation of pin adapter fitting 304 in drill pipe section 28*b*. Installation is facilitated using an installation tool 310. Initially, pin adapter fitting 304 is assembled and prepared for installation generally arranged in the manner illustrated, but with deformable conductive body 306 in an undeformed condition. Installation tool 310 includes a plug fitting 311 which threadably engages box end fitting 104*b* of the drill pipe section. A pulling arm body 312 of tool 310 extends through plug fitting 311 and defines opposing, elongated pulling arms 314 having outwardly extending hook portions 316 at their ends. The pulling arm body is configured for lateral movement relative to plug fitting 311 by a threaded arrangement. The pulling arms themselves are configured such that, in the absence any external forces, hook portions 316 move towards one another (not shown) such that the hook portions may be inserted into the central through opening of pin adapter fitting 304 for positioning as illustrated whereby to allow plug fitting 311 to be threaded into box end fitting 104*b*. Thereafter, a T-handle 318 forming part of tool 310 is turned in a way which engages a ball bearing 320 with locking arms 314 to move the locking arms radially outwardly such that hook portions 316 are in position to engage the adapter fitting with lateral movement of the hook portions. At this point, a locking handle 324, which threadably engages pulling arm body 312, is turned so as to bias a washer 326 against plug fitting 311 to move the pulling arm body and, hence, the hook portions laterally in the direction indicated by an arrow 328. Sufficient force applied using the locking handle causes deformable body 306 of the adapter fitting to deform outwardly against compression sleeve 130, as illustrated, to lock pin adapter fitting 304 in position. It should be appreciated that end contacts 148 engage plug fitting 311 as the adapter fitting is moved in the direction of arrow 322. Therefore, proper lateral positioning of the adapter fitting is automatically achieved using tool 310. T-handle 318 is then backed off to disengage ball bearing 320 from locking arms 314 such that tool 310 may be removed from installed pin adapter fitting 304. Installation of box adapter fitting 302 is performed in essentially the same manner except that the configuration of plug fitting 311 is modified (not shown) to accommodate the use of the tool with pin end fitting 104*a* of a drill pipe section and to facilitate automatic positioning of box adapter fitting 302.

Figure 10:
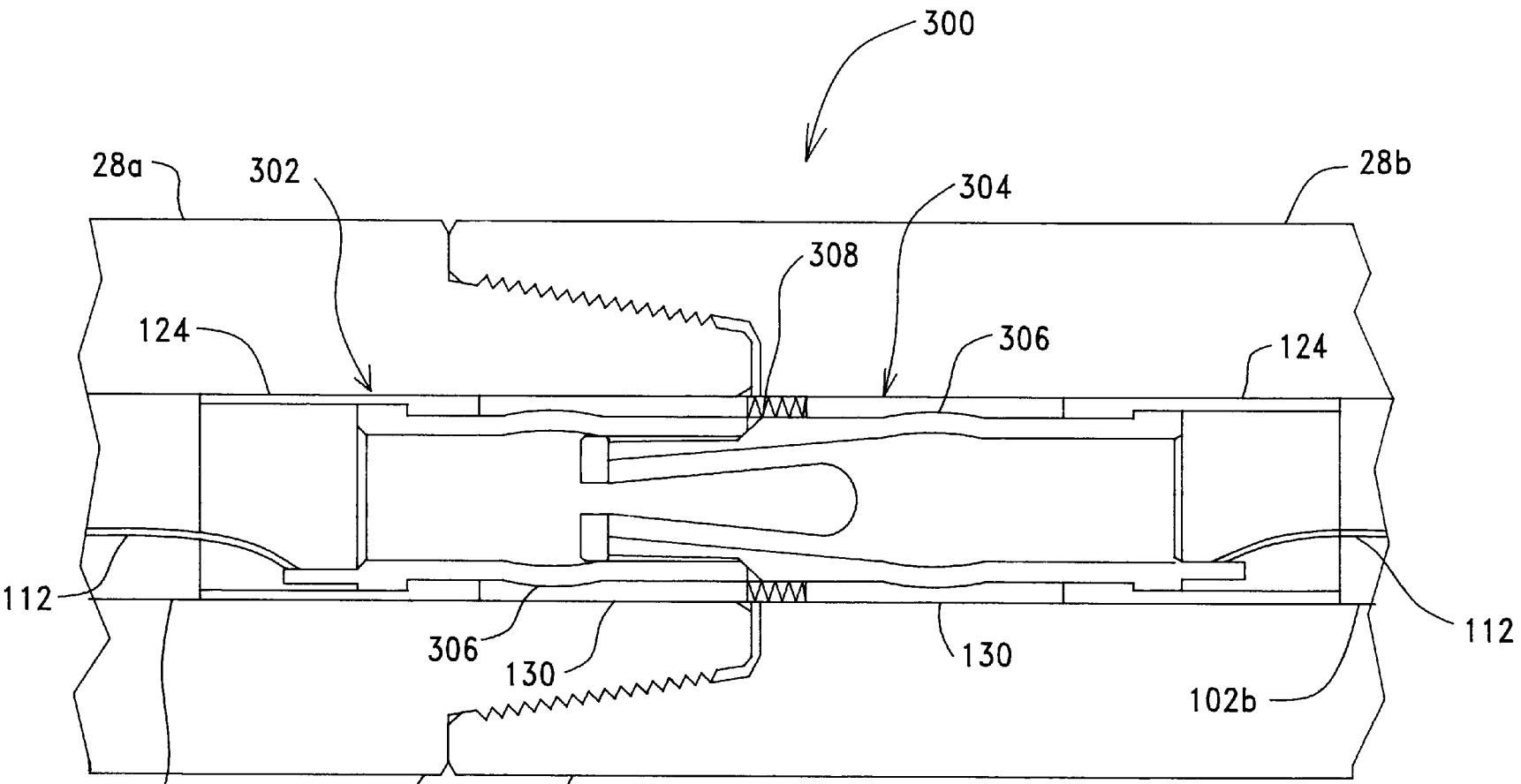
FIG. 10 is diagrammatic cross-sectional view showing mated, adjacent ends of the pair of drill pipe sections of FIG. 8 illustrating mated pin and box adapter fittings according to the third embodiment of the invention which automatically form a continuous, isolated electrically conductive path.

FIG. 10 illustrates drill pipe sections 28*a* and 28*b* mated and having adapter fittings 302 and 304 installed and mated therein. It should be appreciated that descriptions above relating to arrangement 100 are equally applicable to arrangement 300 with regard to adapter fittings 302 and 304 engaging one another as the drill pipe sections are joined. Moreover, arrangement 300 shares all of the advantages described above with regard to arrangement 100. In addition, as the drill pipe sections engage one another, bellows 308 is compressed between adapter fittings 302 and 304 so as to lengthen the ground path between the adapter fittings and the drill pipe sections (via drilling fluid) for purposes described previously. It should be appreciated that bellows 308 may readily be used in arrangement 100 described above. Bellows 308 may be formed from any suitable material including, but not limited to polyurethane. Mounting of the bellows, as described above, may advantageously accommodate replacement of the bellows in the event of damage.

Figure 11:
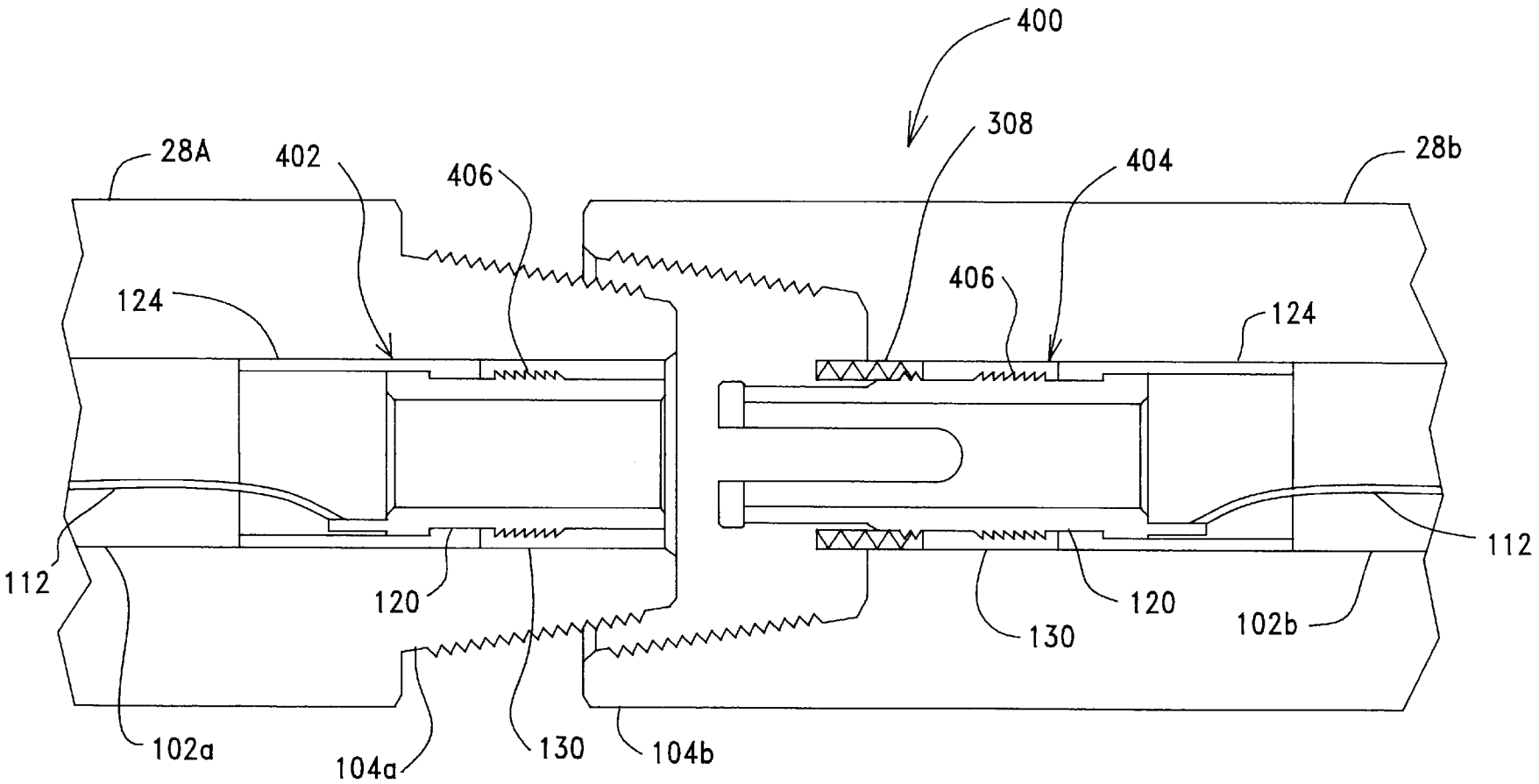
FIG. 11 is a diagrammatic cross sectional view of adjacent ends of the pair of adjacent drill pipe sections shown here to illustrate a fourth third embodiment of an arrangement manufactured in accordance with the present invention for automatically forming a continuous, isolated electrically conductive path between a drill rig and in-ground device.

FIG. 11 illustrates a fourth embodiment of an arrangement manufactured in accordance with the present invention and generally indicated by reference numeral 400 for automatically extending and retracting electrically isolated conductors provided in a segmented drill string. Once again, arrangement 300 is configured for use with standard drill pipe sections such as drill pipe section 28. FIG. 11 illustrates drill pipe sections 28*a* and 28*b* having arrangement 400 installed therein and with adjacent drill pipe sections in partial alignment. The present embodiment may be provided as an after market kit for installation in commercially available drill pipe sections already in field service or for incorporation by manufacturers producing new drill pipe sections.

Arrangement 400 includes a box adapter fitting 402 which preferably is positioned in through hole 102*a* of drill pipe section 28*a* and a pin adapter fitting 404 which preferably is positioned in through hole 102*b* of drill pipe section 28*b* for reasons described above with regard to protection of the fittings during drilling operations. Each drill pipe section in an overall drill string (not shown) receives pin adapter tube fitting 404 in its box end fitting 104*b* and box adapter tube fitting 402 in its pin end fitting 104*a*. Insulated conductor 112 (only partially shown in FIG. 11) is used to electrically interconnect the pin and adapter tube fittings associated with each drill pipe section, as described above.

Because arrangement 400 is similar to arrangements 100 and 300 described above, present discussions will be limited primarily to features of arrangement 400 which differ from those of arrangements 100 and 300. Once again, these features relate, for the most part, to the manner in which the fittings are mounted in the drill pipe section through holes. Specifically, adapter fittings 402 and 404 each include a barbed portion 406 defined by outer peripheral surface 120. Barbed portion 406 engages compression sleeve 130 in a way which radially forces the compression sleeve outwardly against the inner surface of each drill pipe section through hole. It is noted that bellows 308 is present for purposes described above. The installation process (not shown) of adapter fittings 402 and 404 in their respective drill pipe sections may be accomplished, for example, by first inserting the adapter fitting assembly in a though hole without compression sleeve 130. Thereafter, the compression sleeve may be inserted such that compression sleeve 130 is immediately adjacent the opening leading into the through hole and the remainder of the adapter is immediately adjacent the compression sleeve but behind the compression sleeve. Using a tool that is similar to tool 310 of FIG. 9, but which includes appropriate modifications, adapter fitting 402 or 406 may then be drawn forward, toward the opening of the through hole while retaining compression sleeve 130 and bellows 308 in position such that barbed portion 406 engages compression sleeve 130. The adapter fitting is drawn forward to the extent required to arrive at the illustrated configuration. For purposes of brevity, mated drill pipe sections bearing adapter fittings 402 and 406 are not illustrated since these adapter fittings engage in the manner illustrated in FIG. 4 for arrangement 100 and in FIG. 10 for arrangement 300. It should be appreciated that, arrangement 400 shares all of the advantages described above with regard to previously described arrangements. An extraction tool can be used to remove the connection adapters for replacement.

Figure 12:
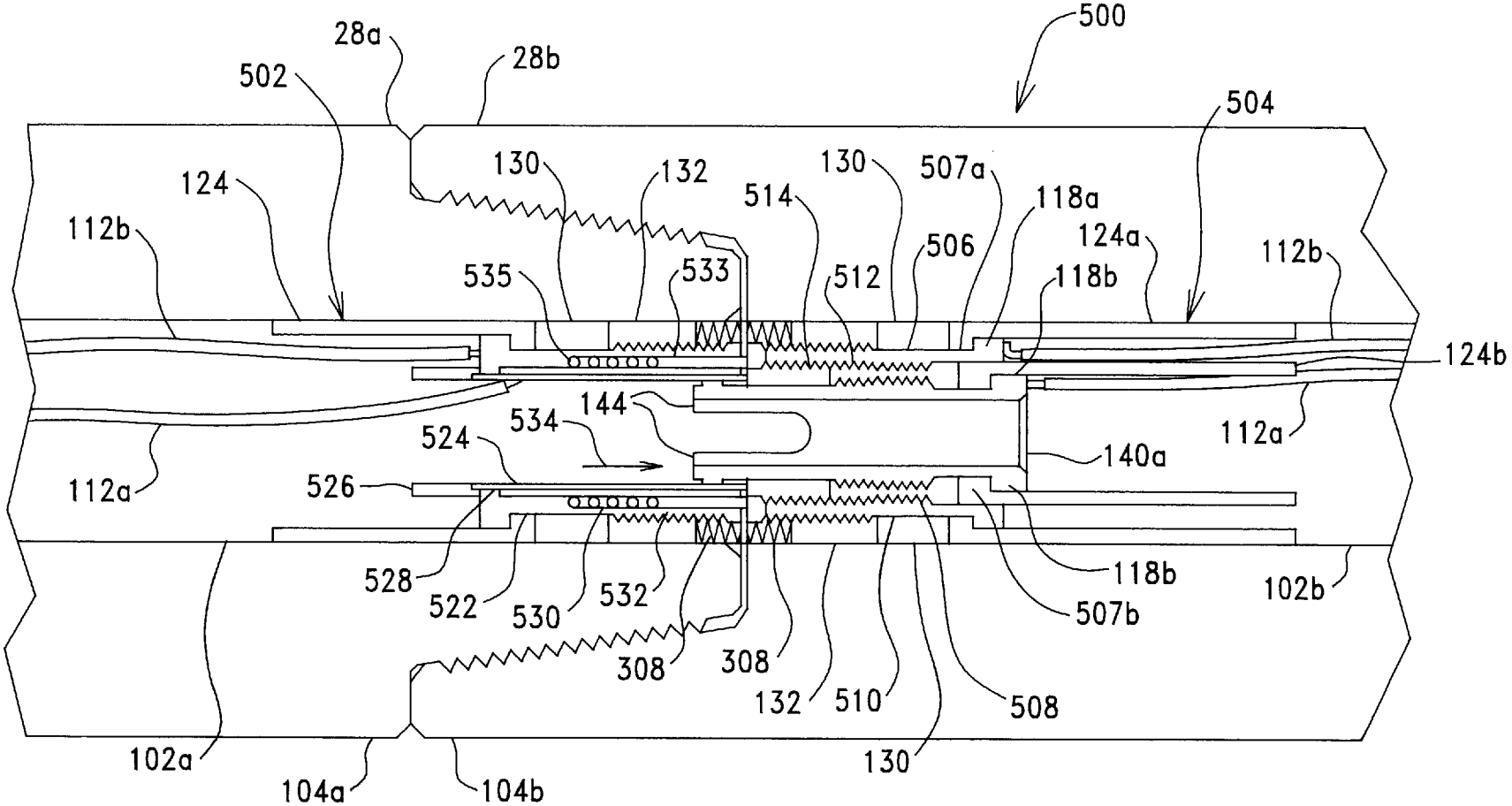
FIG. 12 is a diagrammatic cross sectional view of adjacent ends of the pair of adjacent drill pipe sections shown here to illustrate a multi-conductor embodiment of an arrangement manufactured in accordance with the present invention for automatically forming two continuous, isolated electrically conductive paths between a drill rig and in-ground device.

Attention is now directed to FIG. 12 which illustrates a multiple conductor arrangement manufactured in accordance with the present invention and generally indicated by reference numeral 500 for automatically extending and retracting two different (i.e., parallel) isolated conductors provided in a segmented drill string. As in previously described embodiments, arrangement 500 is configured for use with standard drill pipe sections such as drill pipe section 28. FIG. 12 illustrates drill pipe sections 28*a* and 28*b* having arrangement 500 installed therein and with the adjacent drill pipe sections attached to one another. Furthermore, it should be appreciated that arrangement 500 may be provided as an after market kit for installation in commercially available drill pipe sections which may already be in service or for installation in new drill pipe sections.

Arrangement 500 includes a multi-conductor box adapter fitting 502 which preferably is positioned in through hole 102*a* of drill pipe section 28*a* and a multi-conductor pin adapter fitting 504 which preferably is positioned in through hole 102*b* of drill pipe section 28*b* for reasons described above with regard to protection of the adapter fittings during drilling operations. The two conductive paths established by arrangement 500 will be referred to as the "inner" and "outer" conductive paths for descriptive reasons and for purposes of clarity. Adapter fittings 502 and 504 have been named in accordance with the configuration of the inner conductive path since this configuration will be familiar to the reader from previous descriptions. Each drill pipe section in an overall drill string (not shown) receives multi-conductor pin adapter fitting 504 in its box end fitting 104*b* and multi-conductor box adapter fitting 502 in its pin end fitting 104*a*. Insulated conductors 112*a* (only partially shown) are used to electrically interconnect the components associated with the inner conductive path while insulated conductor 112*b* is used to electrically interconnect the components associated with the outer conductive path.

Still referring to FIG. 12, arrangement 500 includes an insulating sleeve 124*a* which is similar to previously described insulating sleeve 124. It is noted that the identification letter "a" has been appended to the reference number 124 for purposes of clarity since another similarly configured insulating sleeve is associated with the inner conductive path. Identification letters have been appended to reference numbers where appropriate to ensure clarity. An outer path conductive body 506 engages an inwardly projecting collar 507*a* of insulating sleeve 124*a* using an outwardly projecting collar 118*a*. Compression collar 130 is positioned around outer path conductive body 506 immediately adjacent to insulating sleeve 124*a*. Locking ring 132 is threadably engaged with the outer path conductive body. In this regard, multi-conductor box adapter fitting 502 is similarly configured using insulating sleeve 124, compression collar 130 and locking ring 132. It should be appreciated that installation of adapter fittings 502 and 504 within a drill pipe through hole is accomplished in essentially the same manner as described previously with regard to arrangement 100 using the locking ring/compression collar configuration. Arrangement 500 also includes bellows 308 on both the multi-conductor box and pin adapter fittings for reducing the drilling fluid ground path. Moreover, dielectric coatings may be applied to conductive portions of the fittings except, of course, at electrical contact points. Outer path conductive body 506 defines a through opening which receives an inner path conductive body 140*a* and supporting components to be described immediately hereinafter.

Continuing to refer to FIG. 12, inner path conductive body 140*a* is similar in configuration to conductive body 140 in defining contact fingers 144. Inner path conductive body 140*a* is received in outer path conductive body 506 using an inner insulating sleeve 124*b* having an inwardly projecting collar 507*b* which engages outwardly projecting collar 118*b* formed by the inner path conductive body. An electrically insulating thread ring 508 bears both inner and outer threads and may be formed from suitable materials including, but not limited to delrin. The inner threads of thread ring 508 are threadably engaged with threads 510 defined by inner path conductive body 140*a* so as to bias inner insulating sleeve 124*b* against peripheral collar 118*b* of the inner path conductive body. Outer threads of thread ring 508 are, in turn, threadably engaged with inner threads 512 defined by outer path conductive body 506. An insulating ring 514 bearing only an outer thread is engaged with the inner thread of outer path conductive body 506 to minimize contact between the inner path conductive body and drilling fluid (not shown) whereby to reduce the aforementioned drilling fluid ground path. Assembly of multi-conductor pin adapter fitting 504 proceeds by placing inner insulating sleeve 124*b* onto inner path conductive body 140*a* followed by threading on thread ring 508. This assembly is then threaded into outer path conductive body 506, as shown. Insulating ring 514 is then passed over contact fingers 144 and threadably engaged with outer path conductive body 506. Thereafter, outer insulating sleeve 124*a* is installed, followed by compression collar 130 and locking ring 132. Bellows 308 may be secured, for example, using an interference fit which allows for ready replacement of the bellows with operational wear and tear. Installation of multi-conductor pin adapter fitting 506 in drill pipe through hole 102*b* is accomplished in the manner described with regard to arrangement 100, as described above. Conductors 112*a* and 112*b* may be attached, for example, by spot welding (not shown).

Having described multi-conductor pin adapter fitting 504, a description will now be provided of multi-conductor box adapter fitting 502. The latter includes an outer conductive member 522 that is similar in configuration to conductive body 114 of FIGS. 2 and 3A in that it is configured for receiving insulating sleeve 124, compression collar 130 and locking ring 132 for locking fitting 502 into position within drill pipe opening 102*a*. An inner conductive member 524 is supported within outer conductive member 522 by an electrically insulating sleeve member 526. The latter extends into drill pipe through hole 102*a* beyond member 524 in order to reduce the drilling fluid ground path and defines a lip 526 abutting the inward edge of inner conductive member 524 which serves to prevent lateral movement of the inner conductive member into through hole 102*a*. Inner conductive member 524 may be affixed within insulating sleeve member 526 to avoid lateral movement in an opposing direction, for example, by using structural bonding or interference fitting. Insulating sleeve member 526 further defines a notch 528 which cooperates with outer conductive member 522 to prevent relative movement therebetween. Additional components of fitting 504 include a cylindrical spring 530 and a contact ring 532 which are received within a slot 533 defined between insulating sleeve member 526 and outer conductive member 522 such that contact ring 532 is biased in the direction indicated by an arrow 534. A base loop 535 of spring 530 is attached to outer conductive member 522, for example, by spot welding (not shown) to maintain an electrical connection therebetween. Spot welding may, in turn, be used to attach spring 530 to contact ring 532. When adjacent drill pipe sections are mated, as illustrated, contact ring 532 is resiliently biased against outer conductive body 506 to maintain outer path electrical connection between adjacent drill pipe sections. In an alternative single conductor arrangement, it should be appreciated that the outer path configuration (i.e., using contact ring 532, spring 530 and associated components) may advantageously be utilized in implementing a single, isolated electrically conductive path between the boring tool and drill rig.

Assembly of multi-conductor box end fitting may be performed by first installing spring 530 and contact ring 532 within outer conductive member 522 and performing appropriate spot welding. Insulating sleeve 526 may then be snapped into place using notch 528 as inner conductive member 524 is inserted into and glued within sleeve 526. Sleeve 124, compression collar 130 and locking ring 132 may then be installed about the periphery of outer conductive member 522 followed by bellows 308.

Operation of arrangement 500 is essentially identical to that of previously described arrangements 100 and 300 with regard to the inner conductive path. That is, contact fingers 144 engage the inner surface of inner conductive member 524 as adjacent drill pipe sections are mated. Therefore, advantages attendant to protection of the inner conductive path components during drill pipe handling and connection are equally applicable. Components which make up the outer conductive path enjoy similar protection. Specifically, the configuration used in the outer conductive path, like that of the inner conductive path, serves to protect its components while the drill pipe sections are handled and brought into alignment. As adjacent drill pipe sections are mated, contact ring 532 engages outer path conductive body 506 to form an electrical contact therewith only after the adjacent drill pipe sections are threaded together in substantial alignment. Thereafter, electrical contact is maintained by spring 530 urging contact ring 532 toward outer path conductive body 506 such that the outer paths of adjacent drill pipe sections are automatically electrically connected as the drill pipe sections are mated. Considering the overall configuration of arrangement 500, it should be appreciated that this arrangement is devoid of points at which accumulation of drilling fluid, once dried out, will affect subsequent electrical connections from being reliably formed between both the inner and outer conductive paths of adjacent drill pipe sections.

As discussed previously, a single isolated conductive path may, at once, serve in the transfer of data and for supplying power. In this regard, it should be appreciated that the dual conductive path configuration of arrangement 500 is useful for operation in a "fail-safe" mode in which, for example, the system may automatically switch from a conductive path which fails or exhibits instability to the other conductive path. Other applications of a multiple conductor configuration include, for example, providing signals and power to multiple electronic modules and increasing signal bandwidth by separating signal and power path.

In other multiple conductive path arrangements (not shown), a first adapter fitting may be designed to engage electrical contact surfaces of a second adapter fitting as the first and second adapters are engaged when adjacent drill pipe sections are attached to one another. The contact surfaces may be formed on an inner surface of the first adapter within a through opening defined for the passage of drilling fluid. When adjacent drill pipe sections are connected, the contact arrangement of a second adapter fitting may extend into the first adapter to form an electrical connection with each contact surface. The contact surfaces may be arranged in electrically isolated and side by side in a segmented manner cooperating to circumferentially surround the through opening in the first adapter. Alternatively, the contact surfaces may be arranged in an electrically isolated manner as coaxial rings such that each contact surface extends around the inner surface of the through opening in the first adapter.

With regard to production of drill pipe sections in accordance with the present invention that are configured for automatically maintaining an electrically isolated electrical pathway between the boring tool and drill rig, it should be appreciated that drill pipe sections may be modified during or after manufacture in a number of different ways (not shown) in order to accommodate adapter fittings designed to cooperate with these modifications and manufactured in accordance with the present invention. For example, the through hole of drill pipe sections may be threaded immediately adjacent each end of the drill pipe section. In this way, adapter fittings may be configured with a mating thread such that the adapter fittings may be installed by simple threadable engagement in the through openings of drill pipe sections. As another example, each end of the drill pipe opening may include a diameter that is enlarged relative to the remainder of the through opening extending between the ends of the drill pipe section so as to define a peripheral shoulder surrounding the entrance to the overall reduced diameter remainder of the through opening. Adapter fittings manufactured in accordance with the present invention may be positioned in the enlarged diameter opening at each end of the drill pipe section received against the peripheral shoulder. When adjacent drill pipe sections are attached with one another, adapter fittings therein are "trapped" between the peripheral shoulders of the respective drill pipe sections. Such adapter fittings may be retained in the enlarged diameter using, for example, a suitable adhesive. Moreover, these adapter fittings, as is the case with all arrangements disclosed herein, may include arrangements for reducing the drilling fluid ground path such as an insulating sleeve on each fitting wherein the insulating sleeves of mated adapter fittings engage one another in a resilient manner (see, for example, insulating tube 222, FIG. 7 and bellows 308, FIG. 10).

In that the arrangements and associated methods disclosed herein may be provided in a variety of different configurations and modified in an unlimited number of different ways, it should be understood that the present invention may be embodied in many other specific forms without departing from the spirit of scope of the invention. Therefore, the present examples and methods are to be considered as illustrative and not restrictive, and the invention is not to be limited to the details given herein, but may be modified within the scope of the appended claims.

What is claimed is:

1. In a system in which a boring tool is moved through the ground in a region, said system including a drill rig and a drill string which is connected between said boring tool and said drilling and is configured for extension and/or retraction from said drill rig such that, when said drill string is extended, the boring tool moves in a forward direction through the ground and, when the drill string is retracted, the boring tool moves in a reverse direction approaching the drill rig, said drill string being made up of a plurality of drill pipe sections, each of which includes a section length defining an innermost passage and all of which are configured for removable attachment with one another to facilitate the extension and retraction of the drill string by one section length at a time, the improvement comprising:

an arrangement positioned within the innermost passage of each drill pipe section for providing part of at least one electrically conductive path along the section length of each drill pipe section, which electrically conductive path is electrically isolated from its associated drill pipe section and extends from the boring tool to the drilling rig such that the electrically conductive path is extended by said section length when the drill string is extended by attachment of an additional drill pipe section to the drill string at the drill rig and said electrically conductive path is shortened by said section length when the drill string is shortened by detaching the additional drill pipe section from the drill string at the drill rig.

2. The improvement of claim 1 wherein each drill pipe section includes opposing first and second ends having first and second end fittings, respectively, such that adjacent drill pipe sections which form the drill string are attached to one another using one first end fitting mated with one second end fitting and wherein said arrangement includes first and second adapters configured for installation within said innermost passage at corresponding opposing ends of each drill pipe section such that the first and second adapters of adjacent drill pipe sections mate when the first and second end fittings of adjacent drill pipe sections are mated to form an electrical connection as additional drill pipe sections are added to the drill string in a way which extends said electrically conductive path along the section length of the additional drill pipe section.

3. The improvement of claim 2 wherein said arrangement further includes an insulated electrical conductor positioned in said innermost passage and in electrical communication with said first and second adapters such that the electrical conductor forms a portion of said electrically conductive path between the first and second adapters.

4. The improvement of claim 3 wherein said first and second adapters each include connector means for attachment to said insulated electrical conductor.

5. The improvement of claim 4 wherein said attachment means includes a crimp connection.

6. The improvement of claim 2 wherein said first and second end fittings include a self aligning configuration which causes adjacent drill pipe sections to move into an aligned arrangement as the first end fitting of one of the adjacent drill pipe sections engages the second end fitting of the other one of the adjacent drill pipe sections and wherein said first and second adapters of the adjacent drill pipe sections are configured to engage one another at a predetermined point when the first and second end fittings of the adjacent drill pipe sections are partially engaged and the adjacent drill pipe sections have moved, at least to some extent, into said aligned arrangement such that engagement of the first and second end fittings of the adjacent drill pipe sections serves, at least to some extent, to align the first and second adapters prior to the first and second adapters engaging one another to form said electrical connection as the adjacent drill pipe sections are attached.

7. The improvement of claim 2 wherein said arrangement is configured such that said electrically conductive path is shortened by said section length as the drill string is shortened by separating the first and second adapters which are mated between the additional drill pipe section and its adjacent drill pipe section as the additional drill pipe section is detached from the drill string to break said electrical connection.

8. The improvement of claim 2 wherein each drill pipe section defines an opening leading into said innermost passage at each of said opposing ends and wherein one of said first or second adapters is received in said innermost passage in proximity to the opening defined at one end of each drill pipe section and the other one of said first or second adapters is received in said innermost passage in proximity to the opening defined at the other end of each drill pipe section such that the first and second adapters of adjacent drill pipe sections mate to form said electrical connection when the first and second end fittings of adjacent drill pipe sections are mated.

9. The improvement of claim 8 wherein said first end fitting at the first end of one drill pipe section is a box fitting and said second end fitting at the other end of the drill pipe section is a pin fitting and wherein said first adapter installed in the innermost passage in proximity to the first end fitting includes a pin configuration and the second adapter installed in the innermost passage in proximity to the second end fitting includes a box configuration.

10. The improvement of claim 9 wherein the box configuration of said second adapter defines a contact surface and the pin configuration of said first adapter includes contact means for forming an electrical connection with the contact surface as the first and second ends of adjacent drill pipe sections are attached to one another.

11. The improvement of claim 10 wherein said contact means includes at least one contact finger configured for forming said electrical connection with said contact surface.

12. The improvement of claim 11 wherein said first and second adapters are configured such that mated first and second adapters, received in the innermost passages of a pair of adjacent drill pipe sections in the drill string, define a through opening between the innermost passages of the pair of adjacent drill pipe sections such that the innermost passages of the pair of adjacent drill pipe sections are in communication via the through opening of the mated first and second adapters and wherein said second adapter is configured having an inner surface defining a portion of said through opening and said contact surface is formed on said inner surface such that said contact finger extends into the portion of the through opening defined by the second adapter to form said electrical connection with the contact surface when the first and second adapter are mated.

13. The improvement of claim 8 wherein said first and second adapter are affixed in said innermost passage using an adhesive.

14. The improvement of claim 8 wherein said first and second adapters each include attachment means and a first or second adapter body, respectively, said attachment means for holding the first and second adapter bodies in proximity to the drill pipe openings.

15. The improvement of claim 14 wherein said attachment means is selectively connectable with the first and second adapter body such that the attachment means can be replaced and the first and second adapter bodies may be used with a different drill pipe section.

16. The improvement of claim 15 wherein said attachment means and said first and second adapter bodies are configured for threadable engagement.

17. The improvement of claim 14 wherein the attachment means is configured to be received by said innermost passage to hold the first and second adapters in proximity the drill pipe openings.

18. The improvement of claim 14 wherein said attachment means includes a barbed arrangement designed to be radially compressed within said innermost passage to hold the first and second adapters in proximity the drill pipe openings.

19. The improvement of claim 18 wherein the drill pipe section at each opposing end defines an interior thread within the openings leading into said innermost passage and said attachment means includes a threaded arrangement designed to be received by said interior thread to hold the first and second adapters in proximity to the drill pipe openings.

20. The improvement of claim 8 wherein said first and second end fittings include a self aligning configuration which causes adjacent drill pipe sections to move into an aligned arrangement as the first end fitting of one of the adjacent drill pipe sections engages the second end fitting of the other one of the adjacent drill pipe sections and wherein said first and second adapters of the adjacent drill pipe sections are configured to engage one another at a predetermined point when the first and second end fittings of the adjacent drill pipe sections are partially engaged and the adjacent drill pipe sections have moved, at least to some extent, into said aligned arrangement such that engagement of the first and second end fittings of the adjacent drill pipe sections serves, at least to some extent, to align the first and second adapters prior to the first and second adapters engaging one another to form said electrical connection as the adjacent drill pipe sections are attached.

21. The improvement of claim 8 wherein said innermost passage of each drill pipe section includes an interior surface and an interior diameter and wherein said first and second adapters include a locking arrangement having a pre-installation diameter which is less than the interior diameter of the innermost passage of the drill pipe sections such that the first and second adapters are initially slidably receivable in the innermost passage and, after the first and second adapters are positioned at desired locations in said innermost passage, said locking arrangement is configured to be expanded radially against the interior surface of the innermost passage in a way which fixes the position of the first or second adapter.

22. The improvement of claim 21 wherein said system is configured to direct drilling mud from the drill rig to the boring tool through the drill string using the innermost passage defined in the drill pipe sections and wherein said locking arrangement includes an expandable elastomeric sleeve to lock each adapter in place and to seal against drilling mud passing between the elastomeric sleeve and the interior surface of the drill pipe section.

23. The improvement of claim 8 wherein said system is configured to direct drilling mud from the drill rig to the boring tool through the drill string using the innermost passages defined in the drill pipe sections and wherein said first and second adapters are configured such that mated first and second adapters, received in the innermost passages of a pair of adjacent drill pipe sections in the drill string, define a through opening between the through holes of the pair of adjacent drill pipe sections such that the innermost passages of the pair of adjacent drill pipe sections are in communication via the through opening of the mated first and second adapters for the passage therethrough of said drilling mud.

24. The improvement of claim 8 wherein said first adapter is a box adapter tube fitting and said second adapter is a pin adapter tube fitting, the box and pin adapter tube fittings each including a tubular locking body defining locking edges which cooperate in a way that maintains circumferential expansion of the locking body to fix the box and pin adapter tube in position within the innermost passe of a respective drill pipe section.

25. The improvement of claim 24 wherein said locking edges are serrated such that the pin and box adapter tube fittings including said locking body may be inserted into one of said openings leading into the innermost passage with the locking edges disengaged and, thereafter, the locking body is circumferentially expanded to engage the locking edges with one another to accomplish a ratcheting action which maintains the circumferential expansion against the interior surface of the innermost passage to fix the locking body in position 9. The improvement of claim 8 wherein said first end fitting at the first end of one drill pipe section is a box fitting and said second end fitting at the other end of the drill pipe section is a pin fitting and wherein said first adapter installed in the innermost passage in proximity to the first end fitting includes a pin configuration and the second adapter installed in the innermost passage in proximity to the second end fitting includes a box configuration.

26. The improvement of claim 25 wherein said locking edges extend partially, circumferentially around the locking body.

27. The improvement of claim 24 wherein said pin and box adapter tube fittings are integrally formed from tubular stock.

28. The improvement of claim 27 wherein said pin adapter tube includes a pin head arrangement defining a compression slot such that certain circumferential forces around the pin head arrangement will result in the pin head arrangement having a reduced radius and said box adapter tube fitting includes a box head arrangement configured to engage the pin head arrangement in a way which applies force circumferentially around the pin head arrangement to reduce said diameter so as to insert the pin head arrangement into the box head arrangement forming electrical contact therewith when adjacent drill pipe sections are mated.

29. The improvement of claim 24 wherein said pin and box adapter tube fittings are each inserting into an electrical insulating tube which is disposed between each pin and box adapter tube fitting and the interior surface of one of said innermost passages to provide electrical isolation of the pin and box adapter tube fittings from drill pipe sections.

30. The improvement of claim 24 wherein said locking body includes a length disposed between first and second openings and said locking edges are defined by a through cut having a predetermined configuration extending along said length from said first opening to said second opening.

31. The improvement of claim 1 wherein said arrangement is configured within said innermost passage for providing at least two electrically conductive paths along the section length of each drill pipe section, which electrically conductive paths are electrically isolated from the drill pipe sections and from one another and which extend from the boring tool to the drill rig such that each electrically conductive path is extended by said section length when the drill string is extended by attachment of an additional drill pipe section to the drill string at the drill rig.

32. The improvement of claim 31 wherein each drill pipe section includes opposing first and second ends having first and second end fittings, respectively, such that adjacent drill pipe sections which form the drill string are attached to one another using one first end fitting mated with one second end fitting and wherein said arrangement includes first and second adapters configured for installation at corresponding opposing ends of each drill pipe section such that the first and second adapters of adjacent drill pipe sections mate when the first and second end fittings of adjacent drill pipe sections are mated to form an electrical connection corresponding to each electrically conductive path as additional drill pipe sections are added to the drill string in a way which extends each electrically conductive path along the section length of the additional drill pipe section.

33. In a system in which a boring tool is moved through the ground in a region, said system including a drill rig and a drill string which is connected between said boring tool and said drill rig and is configured for extension and/or retraction from said drill rig such that, when said drill string is extended, the boring tool moves in a forward direction through the ground and, when the drill string is retracted, the boring tool moves in a reverse direction approaching the drill rig, said drill string being made up of a plurality of drill pipe sections, each of which includes a section length defining an innermost passage and all of which are configured for removable attachment with one another to facilitate the extension and retraction of the drill string by one section length at a time, in a method for providing at least one electrically conductive path which is electrically isolated from the drill pipe sections and which extends from the boring tool to the drill rig, the improvement comprising the step of:

configuring each drill pipe section having an associated arrangement within said innermost passage such that said electrically conductive path is extended by one section length through the innermost passage by removably attaching one drill pipe section to an above ground end of said drill string and said electrically conductive path is shortened by one section length by detaching said one drill pipe section from the above ground end of said drill string.

34. In a system in which a boring tool is moved through the ground in a region, said boring tool including an electronic package, said system including a drill rig and a drill string which is connected between said boring tool and said drill rig and is configured for extension and/or retraction from said drill rig such that when said drill string is extended, the boring tool moves in a forward direction through the ground and, when the drill string is retracted, the boring tool moves in a reverse direction approaching the drill rig, said drill string being made up of a plurality of drill pipe sections each of which includes a pipe body defining an innermost passage, each of which includes a section length and all of which are configured for removable attachment with one another to facilitate the extension and retraction of the drill string by one section length at a time, a method for operating said system said method comprising the steps of:

a) configuring each drill pipe section having an arrangement within said innermost passage to provide at least one electrically conductive path between opposing ends of each drill pipe section and electrically isolated from said pipe body;

b) attaching one end of an initial drill pipe section to said boring tool to form an initial portion of the drill string such that said electrically conductive path of the arrangement associated with the initial drill pipe section is in electrical communication with the electronic package in the boring tool; and c) attaching one of the opposing ends of a second drill pipe section to the other, above ground end of the initial drill pipe section in a way which connects the electrically isolated conductive path of the arrangement associated with the second drill pipe section to the electrically isolated conductive path of the arrangement associated with the initial drill pipe section to form an overall electrically isolated conductive path extending between the other, above ground end of the overall conductive path at the drill rig and the boring tool through the innermost passage of each drill pipe section.

35. The method of claim 34 including the step of:

d) advancing the boring tool using the drill string made up of the second drill pipe section and the initial drill pipe section.

36. The method of claim 35 including the step of electrically energizing said overall isolated electrically conductive path as the boring tool is advanced.

37. The method of claim 36 wherein said overall isolated electrically conductive path is electrically energized to provide electrical power to said electronic package.

38. The method of claim 36 wherein said overall isolated electrically conductive path is electrically energized to carry a data signal from said electronic package to the drill rig.

39. The method of claim 35 including the steps of:

e) attaching one of the opposing ends of an additional drill pipe section configured with said arrangement to the above ground end of the drill string in a way extends the drill string and which connects the electrically isolated conductive path defined within the innermost passage of the additional drill pipe section to the overall isolated electrically conductive path such that, as the additional drill pipe section is attached to the drill string, the overall electrically conductive path is extended by one section length; and f) further advancing the boring tool using the extended drill string.

40. The method of claim 39 including the step of successively repeating steps (e) and (f) until such time that the boring tool has been advanced by a desired amount.

41. The method of claim 39 including the step of:

g) electrically energizing the overall electrically conductive path as the boring tool is advanced using the drill string.

42. The method of claim 41 including the step of repeating steps (e) through (g), in sequence, until such time that the boring tool has been advanced by a desired amount.

43. In a system in which a boring tool is moved through the ground in a region using a drill rig, said system including a drill rig and a drill string which is connected between said boring tool and said drill rig and is made up of a plurality of drill pipe sections such that the drill string can be advanced or retracted from said drill rig to move the boring tool in a forward direction or in a reverse direction, respectively, through the ground, each drill pipe section comprising:

a) first and second opposing ends and an elongated body having a length between said opposing ends and defining a through hole along said length, the opposing ends being configured for removable attachment with the opposing ends of other drill pipe sections within the drill string; and b) an arrangement for providing at least one electrically conductive path along said length between said opposing ends which electrically conductive path is electrically isolated from said elongated body and which arrangement is configured for electrical connection to the electrically conductive path of another one of the drill pipe sections such that attaching one of the first or second opposing ends of a first drill pipe section to the other one of the first or second opposing ends of a second drill pipe section electrically interconnects the electrically conductive paths of the first and second drill pipe sections.

44. The drill pipe section of claim 43 wherein said first and second opposing ends include first and second end fittings, respectively, such that adjacent drill pipe sections which form the drill string are attached to one another using one first end fitting mated with one second end fitting and wherein said arrangement includes first and second adapters configured for installation at corresponding ones of said first and second opposing ends such that the first and second adapters of adjacent drill pipe sections mate when the first and second end fittings of adjacent drill pipe sections are mated to form an electrical connection as additional drill pipe sections are added to the drill string in a way which extends said electrically conductive path along the length of the additional drill pipe section.

45. The drill pipe section of claim 44 wherein said arrangement further includes an insulated electrical conductor positioned in said innermost passage and in electrical communication with said first and second adapters such that the electrical conductor forms part of said electrically conductive path between the first and second adapters associated with each drill pipe section.

46. The drill pipe section of claim 45 wherein said first and second end fittings include a self aligning configuration which causes adjacent drill pipe sections to move into an aligned arrangement as the first end fitting of one of the adjacent drill pipe sections engages the second end fitting of the other one of the adjacent drill pipe sections and wherein said first and second adapters of the adjacent drill pipe sections are configured to engage one another at a predetermined point when the first and second end fittings of the adjacent drill pipe sections are partially engaged and the adjacent drill pipe sections have moved, at least to some extent, into said aligned arrangement such that engagement of the first and second end fittings of the adjacent drill pipe sections serves, at least to some extent, to align the first and second adapters prior to the first and second adapters engaging one another to form said electrical connection as the adjacent drill pipe sections are attached.

47. The drill pipe section of claim 46 wherein an entrance opening leads into said innermost passage at each of said opposing ends and wherein one of said first or second adapters is received in said innermost passage in proximity to the entrance opening defined at one end of said length and the other one of said first or second adapters is received in said innermost passage in proximity to the entrance opening defined at the other end of said length such that the first and second adapters of adjacent drill pipe sections mate to form said electrical connection when the first and second end fittings of adjacent drill pipe sections are mated.

48. The drill pipe section of claim 47 wherein said entrance opening leading into said innermost passage at each of said opposing ends includes a configuration which cooperates with the first and second adapters to retain the first and second adapters in position within the innermost passage.

49. The drill pipe section of claim 48 wherein the configuration of said entrance opening includes peripheral threads and wherein said first and second adapters include mating threads configured to engage said peripheral threads in a way that supports the first and second adapters in position.

50. The drill pipe section of claim 48 wherein the configuration of said entrance opening includes an enlarged diameter which is greater than an overall diameter of the innermost passage extending between the entrance opening at opposing ends of the drill pipe section such that a peripheral shoulder is formed between each entrance opening and the overall innermost passage and wherein said first and second adapters are configured to be received within said enlarged diameter against said peripheral shoulder.

51. The drill pipe section of claim 47 wherein said first end fitting at the first end of said length is a box fitting and said second end fitting at the other end of said length is a pin fitting and wherein said first adapter installed in the innermost passage in proximity to the first end fitting includes a pin configuration and the second adapter installed in the innermost passage in proximity to the second end fitting includes a box configuration.

52. The drill pipe section of claim 47 wherein said first and second adapters each include attachment means and a first or second adapter body, respectively, said attachment means for holding the first and second adapters in proximity to said openings.

53. The drill pipe section of claim 52 wherein said attachment means is selectively connectable with the first and second adapter body such that the attachment means can be replaced and the first and second adapter bodies may be used with a different drill pipe section.

54. The drill pipe section of claim 52 wherein the attachment means is configured to be received by said innermost passage to hold the first and second adapters in proximity to said openings.

55. The drill pipe section of claim 47 wherein said innermost passage along said length is defined by an interior surface and includes an interior diameter and wherein said first and second adapters include a locking arrangement having a pre-installation diameter which is less than the interior diameter of the innermost passage along said length such that the first and second adapters are initially slidably receivable in the innermost passage and, after the first and second adapters are positioned at desired locations in said innermost passage, said locking arrangement is configured to be expanded radially against the interior surface of the innermost passage in a way which fixes the position of the first or second adapter.

56. The drill pipe section of claim 55 wherein said system is configured to direct drilling mud from the drill rig to the boring tool through the drill string using the innermost passage defined along said length of each drill pipe section of the drill string and wherein said locking arrangement includes an expandable elastomeric sleeve to lock each adapter in place and to seal against drilling mud passing between each elastomeric sleeve and each interior surface.

57. The drill pipe section of claim 47 wherein said system is configured to direct drilling mud from the drill rig to the boring tool through the drill string using the innermost passage defined in each drill pipe section of the drill string and wherein said first and second adapters are configured such that mated first and second adapters, received in the innermost passages of a pair of adjacent drill pipe sections in the drill string, define a through opening between the innermost passages of the pair of adjacent drill pipe sections such that the innermost passages of the pair of adjacent drill pipe sections are in communication via the through opening of the mated first and second adapters for the passage therethrough of said drilling mud.

58. The drill pipe section of claim 43 wherein said arrangement within the innermost passage of each drill pipe section is configured for providing at least two electrically conductive paths along said length associated with each drill pipe section, which electrically conductive paths are electrically isolated from each elongated body and from one another and which extend from the boring tool to the drill rig such that each electrically conductive path is extended by said length when the drill string is extended by attachment of an additional drill pipe section to the drill string at the drill rig.

59. In a system in which a boring tool is moved through the ground in a region, said system including a drill rig and a drill string which is connected between said boring tool and said drill rig and is configured for extension and/or retraction from said drill rig such that, when said drill string is extended, the boring tool moves in a forward direction through the ground and, when the drill string is retracted, the boring tool moves in a reverse direction approaching the drill rig, said drill string being made up of a plurality of drill pipe sections having opposing first and second ends and a section length defining an interior passage therebetween and all of which are configured for removable attachment with one another by physically connecting the first end of one drill pipe section with the second end of another drill pipe section to facilitate the extension and retraction of the drill string by one section length at a time, an arrangement for use with each one of the drill pipe sections, said arrangement comprising:

a) opposing first and second electrically conductive connectors adapted for connection with the first and second ends, respectively, of an associated one of said drill pipe sections in an electrically isolated manner, said first and second electrically conductive connectors being configured to be positioned within said innermost passage and to electrically connect with cooperating second and first electrically conductive connectors respectively associated with another one of the drill pipe sections; and b) an electrically conductive wire located in the innermost passage extending between and electrically connected to said first and second electrically conductive connectors of each drill pipe section so as to provide an electrically conductive path interconnecting the first and second connectors and electrically isolated from each drill pipe section such that physical connection of one drill pipe section with another drill pipe section forms at least one continuous electrical path including the electrically conductive wires of the physically connected drill pipe sections and the first and second electrically conductive connectors therebetween whereby, when a series of drill pipe sections are connected together in a drill string, an overall continuous electrically conductive path is provided by the cooperation of said arrangement in each of the connected drill pipe sections which make up the drill string.

60. The arrangement of claim 59 wherein said first and second opposing ends of each drill pipe section include first and second end fittings, respectively, such that adjacent drill pipe sections which form the drill string are attached to one another using one first end fitting mated with one second end fitting and wherein said first and second connectors are configured to mate when the first and second end fittings of adjacent drill pipe sections are mated to form an electrical connection as part of said continuous electrical path.

61. The arrangement of claim 60 wherein said first and second end fittings include a self aligning configuration which causes adjacent drill pipe sections to move into an aligned arrangement as the first end fitting of one of the adjacent drill pipe sections engages the second end fitting of the other one of the adjacent drill pipe sections and wherein said first and second connectors associated with the adjacent drill pipe sections are configured to engage one another at a predetermined point when the first and second end fittings of the adjacent drill pipe sections are partially engaged and the adjacent drill pipe sections have moved, at least to some extent, into said aligned arrangement such that engagement of the first and second end fittings of the adjacent drill pipe sections serves, at least to some extent, to align the first and second connectors prior to the first and second connectors engaging one another to form said electrical connection as the adjacent drill pipe sections are attached.

62. The arrangement of claim 60 wherein each drill pipe section defines an opening leading into said innermost passage at each of said opposing ends and wherein one of said first or second connectors is received in said innermost passage in proximity to the opening defined at one end of said length and the other one of said first or second connectors is received in said innermost passage in proximity to the opening defined at the other end of said length such that the first and second connectors of adjacent drill pipe sections mate to form said electrical connection when the first and second end fittings of the adjacent drill pipe sections are mated.

63. The arrangement of claim 62 wherein said first end fitting at the first end of said length is a box fitting and said second end fitting at the other end of said length is a pin fitting and wherein said first connector installed in the innermost passage in proximity to the first end fitting includes a pin configuration and the second connector installed in the innermost passage in proximity to the second end fitting includes a box configuration.

64. The arrangement of claim 62 wherein said first and second connectors each include attachment means and a first or second connector body, respectively, said attachment means for holding the first and second connector bodies in proximity to said openings.

65. The arrangement of claim 64 wherein said attachment means is selectively connectable with the first and second connector body such that the attachment means can be replaced and the first and second connector bodies may be used with a different drill pipe section.

66. The arrangement of claim 64 wherein the attachment means is configured to be received by said innermost passage to hold the first and second connectors in proximity to said openings.

67. The arrangement of claim 62 wherein said innermost passage along said length is defined by an interior surface and includes an interior diameter and wherein said first and second connectors include a locking arrangement having a pre-installation diameter which is less than the interior diameter of the innermost passage along said length such that the first and second connectors are initially slidably receivable in the innermost passage and, after the first and second connectors are positioned at desired locations in said innermost passage, said locking arrangement is configured to be expanded radially against the interior surface of the innermost passage in a way which fixes the position of the first and second adapter.

68. The arrangement of claim 67 wherein said system is configured to direct drilling mud from the drill rig to the boring tool through the drill string using the innermost passage defined along said length of each drill pipe section of the drill string and wherein said locking arrangement includes an expandable elastomeric sleeve to lock each connector in place and to seal against drilling mud passing between each elastomeric sleeve and each interior surface.

69. The arrangement of claim 62 wherein said system is configured to direct drilling mud from the drill rig to the boring tool through the drill string using the innermost passage defined in each drill pipe section of the drill string and wherein said first and second connectors are configured such that mated first and second connectors, received in the innermost passages of a pair of adjacent drill pipe sections in the drill string, define a through opening between the innermost passages of the pair of adjacent drill pipe sections such that the innermost passages of the pair of adjacent drill pipe sections are in communication via the through opening of the mated first and second connectors for the passage therethrough of said drilling mud.

70. The arrangement of claim 59 configured for providing at least two continuous electrical paths, which electrically conductive paths are electrically isolated from each drill pipe section and from one another and which extend from the boring tool to the drill rig such that each continuous electrical path is extended by said section length when the drill string is extended by attachment of an additional drill pipe section to the drill string at the drill rig.

* * * * *

UNITED STATES PATENT AND TRADEMARK OFFICE

CERTIFICATE OF CORRECTION

PATENT NO. : 6,223,826 B1 
DATED : May 1, 2001
INVENTOR(S) : Albert W. Chau and John E. Mercer It is certified that error appears in the above-identified patent and that said Letters Patent is hereby corrected as shown below:

Column 3,
Line 7, change "is particularly advantageous in since the" to -- is particularly advantageous since the --

Column 4,
Line 2, change "beat-shrinkable" to -- heat-shrinkable --

Column 5,
Line 62, change "a fourth third embodiment" to -- a fourth embodiment --

Column 8,
Line 26, change "drill pipe sections 102" to -- drill pipe sections 28 --
Line 46, change "locking ring 124" to -- locking ring 132 --

Column 12,
Line 11, change "direction directions" to -- directions --

Column 14,
Line 23, change "absence any" to -- absence of any --

Column 19,
Line 46, change "spirit of scope" to -- spirit or scope --
Line 55, change "said drilling and is configured" to -- said drill rig and is configured --

Column 20,
Line 5, change "to the drilling rig" to -- to the drill rig --

Column 22,
Line 38, change "passage" to -- passages --
Line 61, change "innermost passe" to -- innermost passage --

Column 23,
Line 5, change "position 9." to -- position. --
Lines 5-12, delete the sentence "The improvement of claim 8 wherein said first end fitting at the first end of one drill pipe section is a box fitting and said second end fitting at the other end of the drill pipe section is a pin fitting and wherein said first adapter installed in the innermost passage in proximity to the first end fitting includes a pin configuration and the second adapter installed in the innermost passage in proximity to the second end fitting includes a box configuration."

UNITED STATES PATENT AND TRADEMARK OFFICE

CERTIFICATE OF CORRECTION

PATENT NO. : 6,223,826 B1 
DATED : May 1, 2001
INVENTOR(S) : Albert W. Chau and John E. Mercer It is certified that error appears in the above-identified patent and that said Letters Patent is hereby corrected as shown below:

Column 24,
Line 30, insert a comma (,) after such that to read -- from said drill rig such that, --
Line 40, insert a comma (,) after operating said system to read -- operating said sytem, --

Column 25,
Line 13, change "in a way extends the drill string" to -- in a way which extends the drill string --
Line 44, change "a through hole along said length" to -- an innermost passage along said length --
Line 48, change "arrangement for providing" to -- an arrangement located within said innermost passage for providing --

Drawings,
Figure 2, the item label "23a" in the upper left corner should be -- 28a --

Signed and Sealed this

Thirteenth Day of August, 2002

*Attest:*

*Attesting Officer*

JAMES E. ROGAN
*Director of the United States Patent and Trademark Office*